US007701399B2

(12) United States Patent
Aoyama et al.

(10) Patent No.: US 7,701,399 B2
(45) Date of Patent: Apr. 20, 2010

(54) CHIP ANTENNA, AN ANTENNA DEVICE, AND A COMMUNICATION EQUIPMENT

(75) Inventors: Hiroyuki Aoyama, Saitama (JP); Hidetosi Hagiwara, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 498 days.

(21) Appl. No.: 11/757,727

(22) Filed: Jun. 4, 2007

(65) Prior Publication Data

US 2007/0279299 A1 Dec. 6, 2007

(30) Foreign Application Priority Data

Jun. 5, 2006 (JP) ..... 2006-155599

(51) Int. Cl.
*H01Q 1/24* (2006.01)

(52) U.S. Cl. ..... 343/702; 343/700 MS

(58) Field of Classification Search ..... 343/702, 343/700 MS, 893
See application file for complete search history.

(56) References Cited

U.S. PATENT DOCUMENTS 5,684,492 A * 11/1997 Kagoshima et al. ... 343/700 MS
5,854,606 A * 12/1998 Kawahata et al. ..... 343/702
5,936,593 A 8/1999 Mandai et al.
6,539,207 B1 * 3/2003 del Castillo et al. ..... 455/90.3
6,686,884 B2 * 2/2004 Back et al. ..... 343/700 MS
2006/0077105 A1 * 4/2006 Jeong ..... 343/702

FOREIGN PATENT DOCUMENTS

| | | | |
|---|---|---|---|
| EP | 0 762 536 | A2 | 3/1997 |
| EP | 0 863 571 | A2 | 9/1998 |
| EP | 1 178 565 | A1 | 2/2002 |
| EP | 1 225 652 | A1 | 7/2002 |
| EP | 1 505 689 | A1 | 2/2005 |
| JP | 49-40046 | | 4/1974 |
| JP | 10-145123 | | 5/1998 |
| JP | 2005-175757 | | 6/2005 |
| WO | WO 2005/057727 | A1 | 6/2005 |

* cited by examiner

*Primary Examiner*—HoangAnh T Le
(74) *Attorney, Agent, or Firm*—Paul F. Neils, Esq.; Akerman Senterfitt

(57) ABSTRACT

The chip antenna shown is provided with two chip antenna elements (the 1st chip antenna element 4, the 2nd chip antenna element 2). These chip antenna elements have the 1st magnetic base 10 and the 2nd magnetic base 8, and linear conductors 7 and 5 formed in the core, respectively. Magnetic base 10 and magnetic base 8 are separated. In the 1st chip antenna element 4, linear conductor 7 formed in the core of the 1st magnetic base 10 was formed to the end face of this magnetic base, and the end has protruded from said end face. On the other hand, in the 2nd chip antenna element 2, linear conductor 5 formed in the core of the 2nd magnetic base 8 has penetrated magnetic base 8. Furthermore, conductor 7 in the 1st chip antenna element and conductor 5 in the 2nd chip antenna element are electrically connected mutually in series by connection conductors 13 arranged among these chip antenna elements.

34 Claims, 22 Drawing Sheets

CHIP ANTENNA, AN ANTENNA DEVICE, AND A COMMUNICATION EQUIPMENT

BACKGROUND OF THE INVENTION

1. Field of the Invention

This invention relates to a chip antenna used for electronic equipment with a communication function, such as cellular phone, personal digital assistant equipment. Furthermore, this invention relates to an antenna system and communication equipment using this chip antenna.

2. Description of the Related Art

The frequency range in communication equipment, such as a cellular phone and wireless LAN, ranges from hundreds of MHz to several GHz. It is required for this frequency range to be wide and for the efficiency in this range to be high. Therefore, the antenna used for this communication equipment also needs to be high gain in this frequency range, it is needed to be small and to be thin also. In the ground digital broadcasting started in recent years, the frequency range in the television broadcasting in Japan is 470 MHz-770 MHz, for example. When it corresponds to all the channels, it is required that this antenna can receive such a wide frequency range. Conventionally, a chip antenna using dielectric ceramics as a small antenna suitable for mobile communications has been offered (for example, see Japanese Patent No. H10-145 123). When setting frequency constant, miniaturization of a chip antenna can be attained by using dielectrics with a higher dielectric constant. In art given in this document, this wavelength is shortened by providing a meander shaped electrode. Moreover, the antenna aiming at miniaturization is also proposed by shortening a wavelength $1/(\epsilon r \cdot \mu r)^{1/2}$ times using the magnetic material with large relative permittivity $\epsilon r$ and large relative magnetic permeability $\mu r$ (for example, see Japanese Patent No. S49-40046).

Moreover, for example with a small liquid crystal television, the whip antenna using the metal stick is generally used as a receiving antenna currently used for television or radio. This system is beginning to be used also for the cellular phone with television function. Furthermore, the electric wire which is a part of earphones used with a cellular phone, may be used as a receiving antenna of radio or television.

Although the above-mentioned dielectric chip antenna is advantageous for a miniaturization and thinning, there are the following problems to making bandwidth of a frequency range wide. For example, when using a helical-type radiation electrode as an electrode, if a number of turns increases, the capacitance between electric wires will increase and Q value will become high. Therefore, bandwidth becomes narrow and it becomes difficult to apply to uses, such as ground digital broadcasting as which wide bandwidth is required.

Making bandwidth wide and a miniaturization, are possible, with the above-mentioned magnetic material chip antenna. However, the mounting space for electronic parts in communication equipment, especially in portable communication equipment, is restricted. Therefore, it is further necessary to reduce the mounting space which an antenna occupies. However, this chip antenna is generally making rectangular parallelepiped shape, and its size is also large compared with other electronic parts. Therefore, it may be unable to be mounted efficiently spatially.

For example, generally the case of a cellular phone has curved surface shape. Therefore, when arranging the chip antenna of rectangular parallelepiped shape at the end of a case, a spatial loss may arise.

So, this invention aims at offering a chip antenna suitable for efficient mounting within communication equipment in this invention. Also it aims at offering the antenna system and communication equipment using this chip antenna.

SUMMARY OF THE INVENTION

An object of this invention is to solve the above subjects.

This invention is constructed as described below in order to solve the aforementioned problems.

An aspect in accordance with the present invention provides a chip antenna comprising:

a 1st chip antenna element having a 1st magnetic base and a linear conductor formed in the core of said 1st magnetic base, so that one end of said linear conductor has protruded from one end face of said 1st magnetic base at least, a 2nd chip antenna element having a 2nd magnetic base and a linear conductor penetrating said 2nd magnetic base, said conductor of said 1st chip antenna element and said conductor of said 2nd chip antenna element being connected by a connection conductor formed between said 1st chip antenna element and said 2nd chip antenna element in series.

Since this chip antenna is using the base as the magnetic material, it is advantageous in making bandwidth wide and miniaturization. With the above-mentioned structure, a capacity component is hard to form and a magnetic material portion can be effectively operated as an inductance component. This composition contributes the widening of the bandwidth in an antenna and a miniaturization. In this structure, the conductors in two or more chip antenna elements are electrically connected in series.

Therefore, one antenna consists of two or more chip antenna elements. And each chip antenna element is connected with a connection conductor. According to mounting space, the arrangement is changeable. Therefore, this antenna can be spatially mounted in communication equipment etc. efficiently. A chip antenna is divided into two or more chip antenna elements. Therefore, the length of each chip antenna element can be made smaller than the length of a magnetic base required for antenna characteristics. Therefore, shock resistance is improved.

Another aspect in accordance with the present invention provides, said chip antenna, wherein said conductor of said 1st chip antenna element penetrates said 1st magnetic base.

Here, the longitudinal direction of a magnetic base is a direction met the side with the greatest length, when this magnetic base takes rectangular parallelepiped shape. The longitudinal direction of a magnetic base is a direction along that axis, when this magnetic base takes cylindrical shape. The longitudinal direction of a magnetic base is a direction along that circle, if this magnetic base takes arc shape. It is still more preferred that the linear conductor takes linear shape. With this composition, since the portion where two conductive parts face each other, this conductor faces is not formed in a base, especially a capacity component is hard to be formed.

And in said chip antenna, said conductor of said 1st chip antenna element, is preferred to penetrate said 1st magnetic base. With this composition, the linear conductor has penetrated the magnetic base in the structure in all the chip antenna elements. Therefore, a magnetic material portion functions effectively as an inductance component.

Another aspect in accordance with the present invention provides, said chip antenna, wherein two or more said 2nd chip antenna elements are used, wherein said conductors of said 2nd chip antenna elements are connected mutually in series by connection conductors formed between said two or more 2nd chip antenna elements.

According to this composition, the flexibility in the shape of arrangement of a chip antenna becomes high.

Another aspect in accordance with the present invention provides, said chip antenna, wherein both ends of said conductor of said 2nd chip antenna element are protruding from said 2nd magnetic base, wherein one end at least of said conductor of said 1st chip antenna element is protruding from said 1st magnetic base. When the conductor has protruded, it is connectable with these protrusions. Therefore, it is unnecessary to provide an electrode on a magnetic base for connection. Therefore, a capacity component can be decreased. Simplification of the process of constituting a chip antenna and communication equipment is attained. It is more preferred that the conductor of said 1st chip antenna element penetrates said 1st magnetic base, and the both sides of this conductor protrude from said first magnetic base. It becomes possible to fix the both ends of a chip antenna to a substrate etc. using the projected conductor.

Another aspect in accordance with the present invention provides, said chip antenna, wherein said conductor of said 1st chip antenna element, said conductor of said 2nd chip antenna element, and said connection conductor, are united and formed as one linear conductor.

In this composition, two or more chip antenna elements share one linear conductor. In this composition, the conductor in two or more chip antenna elements serves also as connected conductors as it is. Therefore, it is not necessary to provide connected conductors separately, therefore, simplification of the manufacturing process of a chip antenna or communication equipment and improvement in product reliability are achieved.

Another aspect in accordance with the present invention provides, said chip antenna, wherein said 1st chip antenna element and said 2nd chip antenna element are accommodated in one case.

According to this composition, a gap of the position of said 1st chip antenna element and said 2nd chip antenna element decreases. Since it becomes strong to external force, reliability is improved.

Another aspect in accordance with the present invention provides, said chip antenna, wherein a conductor member is formed on the lateral surface of said case.

This conductor member and the conductor part on the substrate which mounts a chip antenna are connected by solder etc. Thereby, this chip antenna is fixable to the substrate etc. This conductor member is preferred to be connected to the end of said conductor of said 2nd chip antenna element, taking opposite side of the 1st chip antenna element. By this composition, the electrical connection between the substrate etc. and the chip antenna, serves also as mechanical connection.

Another aspect in accordance with the present invention provides, antenna device having said chip antenna, and having a substrate on which said chip antenna is mounted.

What is called a sub-substrate is constituted by mounting a chip antenna in a substrate. By using this sub-substrate, maintenance of arrangement of a chip antenna and handling become easy.

Another aspect in accordance with the present invention provides, said antenna device, wherein said 1st chip antenna element and said 2nd chip antenna element are arranged taking curved shape or meander shape.

In said chip antenna, it has a connected-conductors portion among two or more chip antenna elements. Therefore, this connected-conductors portion can be set as a corner, and a chip antenna element can be made into curved shape or meander shaped. Making the chip antenna into a curved shape, means that the longitudinal direction in each chip antenna element forms a predetermined angle mutually. For example, it can take the shape of a V character, the shape of an arch, etc. Meander shaped means the state where a chip antenna element is turned up and arranged. By this composition, the end of portable communication equipment etc. fits the shape of this antenna device also in the mounting space limited by a curved surface, and can be mounted.

Another aspect in accordance with the present invention provides, a communication equipment in which said chip antenna is used.

In said chip antenna, the flexibility in shape becomes high by changing arrangement of two or more chip antenna elements. Therefore, if this is used for communication equipment, it will take the shape of the chip antenna which suited mounting space. Therefore, the communication equipment reducing mounting space, is realizable.

Another aspect in accordance with the present invention provides, said communication equipment, wherein said 1st chip antenna element and said 2nd chip antenna element are arranged taking curved shape or meander shape.

In this chip antenna, it has a connected-conductors portion among two or more chip antenna elements. Therefore, this connected-conductors portion can be set as a corner, and a chip antenna element can be made into curved shape or meander shape. Making the chip antenna into a curved shape, means that the longitudinal direction in each chip antenna element forms a predetermined angle mutually. For example, it can take the shape of a V character, the shape of an arch, etc. Meander shape means the state where a chip antenna element is turned up and arranged. By this composition, the end of portable communication equipment etc. fits the shape of this antenna device also in the mounting space limited by a curved surface, and can be mounted. Therefore, it becomes communication equipment reducing mounting space.

Another aspect in accordance with the present invention provides, said communication equipment, wherein said chip antenna is arranged along the inner side face of a case of said communication equipment.

According to this composition, a chip antenna can be separated from other electronic parts in communication equipment. Therefore, the influence by these electronic parts can be inhibited, and the loss of mounting space can also be reduced.

Another aspect in accordance with the present invention provides, said communication equipment, wherein a substrate on which a conductor part is formed, is used, wherein at least one selected from the group consisting of said connection conductor between said chip antenna elements, and said protruding linear conductor, is connected to said conductor part on said substrate.

According to this composition, each chip antenna element is fixed to a substrate. Therefore, the chip antenna having two or more chip antenna elements, is firmly fixed to a substrate.

Another aspect in accordance with the present invention provides a communication equipment, using said chip antenna, wherein a substrate on which another conductor member is formed, is used, wherein said conductor member on said case and said another conductor member on said substrate, are connected.

The structure in which the case was connected to the substrate, and the chip antenna was fixed to the case, takes excellent shock resistance. The chip antenna can be arranged more firmly in the communication equipment.

According to this invention, a magnetic material chip antenna advantageous to making bandwidth wide and a miniaturization can be obtained. A magnetic material chip antenna suitable for efficient mounting within communication equipment can be obtained. The antenna device and communication equipment with a high flexibility in space where an antenna is mounted, can be offered using this chip antenna.

DETAILED DESCRIPTION OF THE INVENTION

Hereafter, a concrete embodiment is shown and described about this invention. However, this invention is not limited to these embodiments. The same numerals are attached about the same member.

Figure 1:
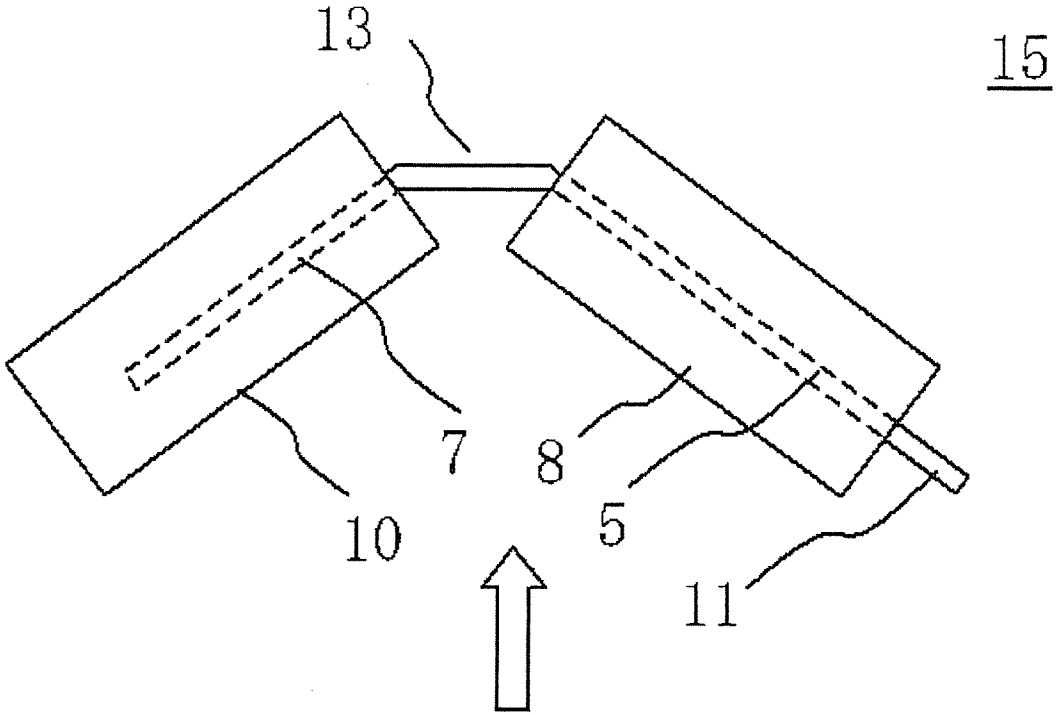
FIG. 1 is a figure showing the chip antenna of the embodiment of this invention.
Figure 1:
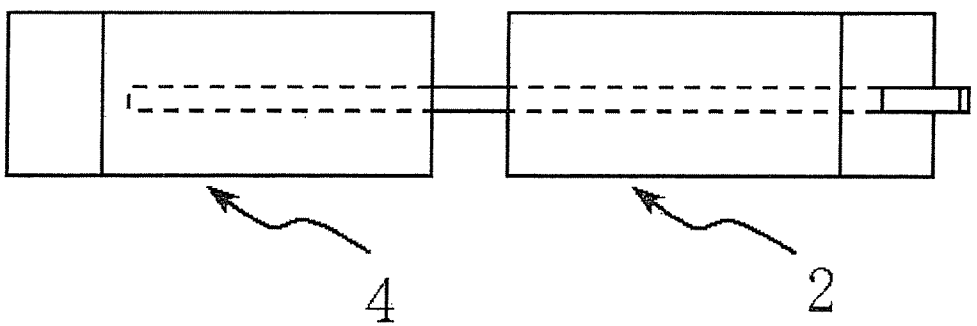

The chip antenna concerning this invention is provided with the 1st chip antenna element and 2nd chip antenna element. In the 1st chip antenna element, it has the 1st magnetic base and the linear conductor which it was provided in the core of said 1st magnetic base, and at least, the one end has protruded from the end face of said 1st magnetic base. In the 2nd chip antenna element, it has the 2nd magnetic base and a linear conductor which penetrates said 2nd magnetic base. The conductor in said 1st chip antenna element and the conductor of each other in said 2nd chip antenna element are connected in series by the connection conductors arranged between said 1st chip antenna element and said 2nd chip antenna element. An example of the embodiment of the chip antenna concerning this invention is shown in FIG. 1. Chip antenna 15 in FIG. 1 is a magnetic material chip antenna with which magnetic material ceramics were used as a base. This chip antenna can be mounted and used for a substrate. (a) in FIG. 1 is a top view (it corresponds to the figure seen from the upper part perpendicular to a substrates surface in case the chip antenna is mounted in the substrate). (b) is the front view seen from the arrow direction in (a). The chip antenna shown in FIG. 1 is provided with two chip antenna elements (the 1st chip antenna element 4, the 2nd chip antenna element 2). These chip antenna elements have the 1st magnetic base 10 and the 2nd magnetic base 8, and linear conductors 7 and 5 formed in the core, respectively. With the structure shown in FIG. 1, magnetic base 10 and magnetic base 8 are separated. However, these can also be partially contacted in the portion of the corner of the magnetic bases. In the 1st chip antenna element 4, linear conductor 7 formed in the core of the 1st magnetic base 10 was formed to the end face of this magnetic base, and the end has protruded from said end face. With the structure in FIG. 1, the other end of conductor 7 exists in the core of magnetic base 10. On the other hand, in the 2nd chip antenna element 2, linear conductor 5 formed in the core of the 2nd magnetic base 8 has penetrated magnetic base 8. Furthermore, conductor 7 in the 1st chip antenna element and conductor 5 in the 2nd chip antenna element are electrically connected mutually in series by connection conductors 13 arranged among these chip antenna elements. In the structure in FIG. 1, each conductor takes linear shape and has penetrated each magnetic base taking rectangular parallelepiped shape along with a longitudinal direction.

In the chip antenna in FIG. 1, said each conductor and said each connection conductors comprise a continuous united line conductor. This structure can also be regarded as the structure where the magnetic base is divided into two, in one chip antenna with which the linear conductor was embedded at the magnetic base. In this structure, the conductor is not wound around a chip like a dielectric chip antenna or a magnetic material chip antenna, with which a conductor constitutes a helical electrode. Therefore, the capacity component generated between the lines of a conductor is not formed. Therefore, a frequency range can be made wide. A magnetic base is divided and each chip antenna element is connected with connection conductors. Therefore, according to mounting space, the arrangement is changeable. In the structure where the magnetic base was divided, the length of each magnetic base can be made small. Therefore, its structural strength becomes high, and becomes hard to break, and the reliability in a chip antenna improves. Therefore, said structure is the structure where the flexibility in mounting is very high, though it is a chip antenna. Why this divided magnetic material chip antenna of structure becomes realizable is mentioned later. In using the chip antenna in FIG. 1, the other end of conductor 7 in said 1st chip antenna element constitutes an open end. End 11 of the conductor in said 2nd chip antenna element is connected to control circuits (not shown), such as a feeder circuit, and an antenna device is constituted. Here, the chip antenna applied to this invention completely differs in structure of the dipole antenna known previously.

Figure 2:
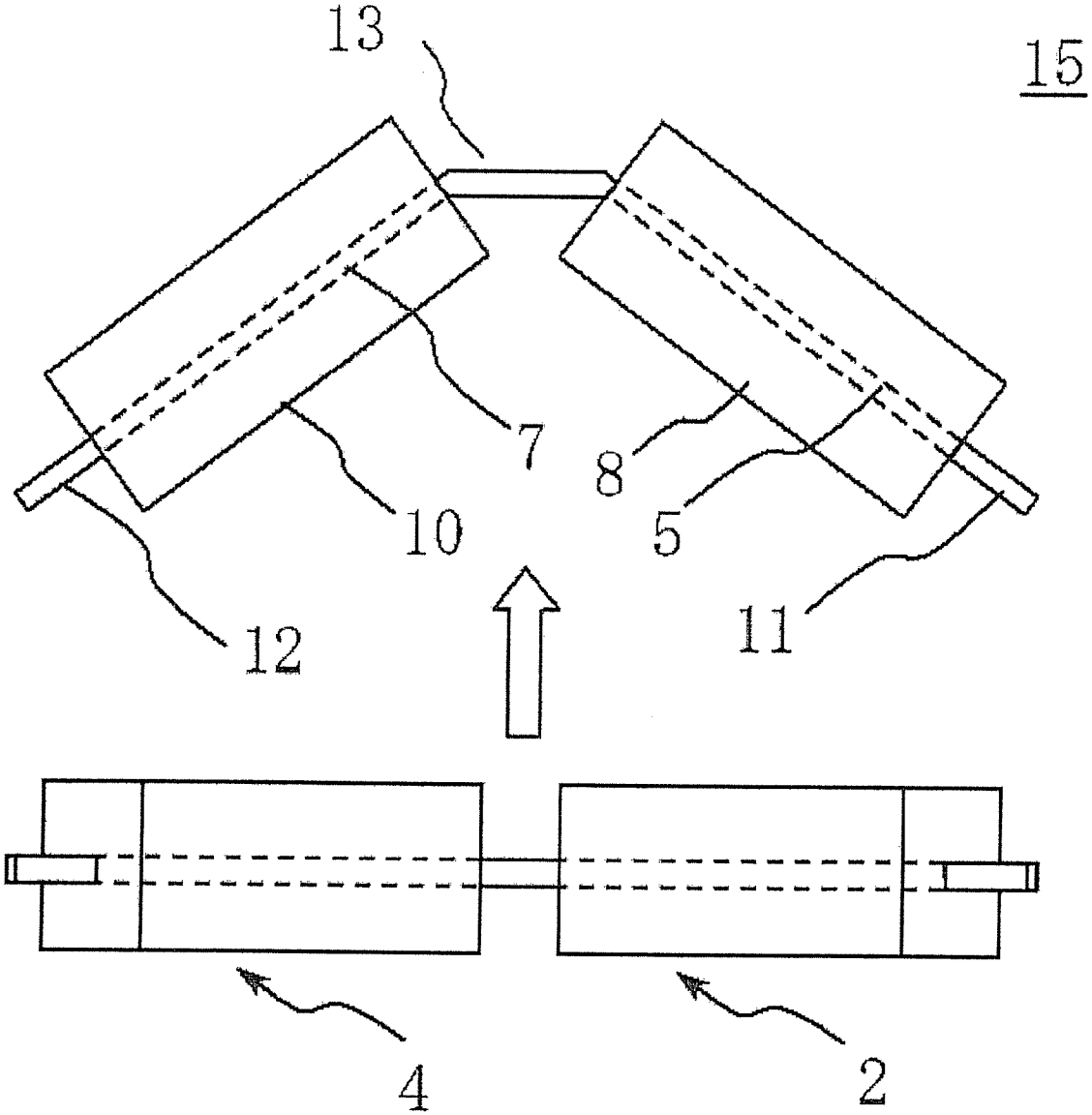
FIG. 2 is a figure showing the chip antenna of other embodiments of this invention.

Another embodiment of a chip antenna is shown in FIG. 2. In chip antenna 15 shown in FIG. 2, linear conductor 7 in said 1st chip antenna element 4 has penetrated said 1st magnetic base 10. Each conductors and each connection conductors comprise a continuous united line conductor. It is the same as the embodiment shown in FIG. 1 here. Said structure can also be regarded as the structure where the magnetic base is divided into two, in one chip antenna which has the structure where a linear conductor penetrates a magnetic base. In addition to the 2nd chip antenna element, the conductor has penetrated also in the 1st chip antenna element. Therefore, when the length of the conductor in a magnetic base is the same, compared with the case where the conductor has not penetrated, the miniaturization of the whole chip antenna can be attained according to the wavelength shortening effect which the magnetic base has. The linear conductor in the 1st chip antenna element has penetrated the magnetic base. Therefore, other circuit elements, electrical connection with an electrode, and junction are possible using the other end of this conductor. Therefore, the flexibility in a design is raised, and it can be fixed more firmly. In addition, in the structure in FIG. 2, the both sides of each conductor have protruded from the magnetic base. Although the both sides of each conductor do not need to protrude, it is necessary to prepare the exterior electrode which aims at connection with the above-mentioned conductor in this case. For example, in this case, an exterior electrode in one chip antenna is connected by solder to the electrode prepared on the substrate, with the exterior electrode in other chip antenna elements, here, chip antenna elements are connected in series.

Figure 6:
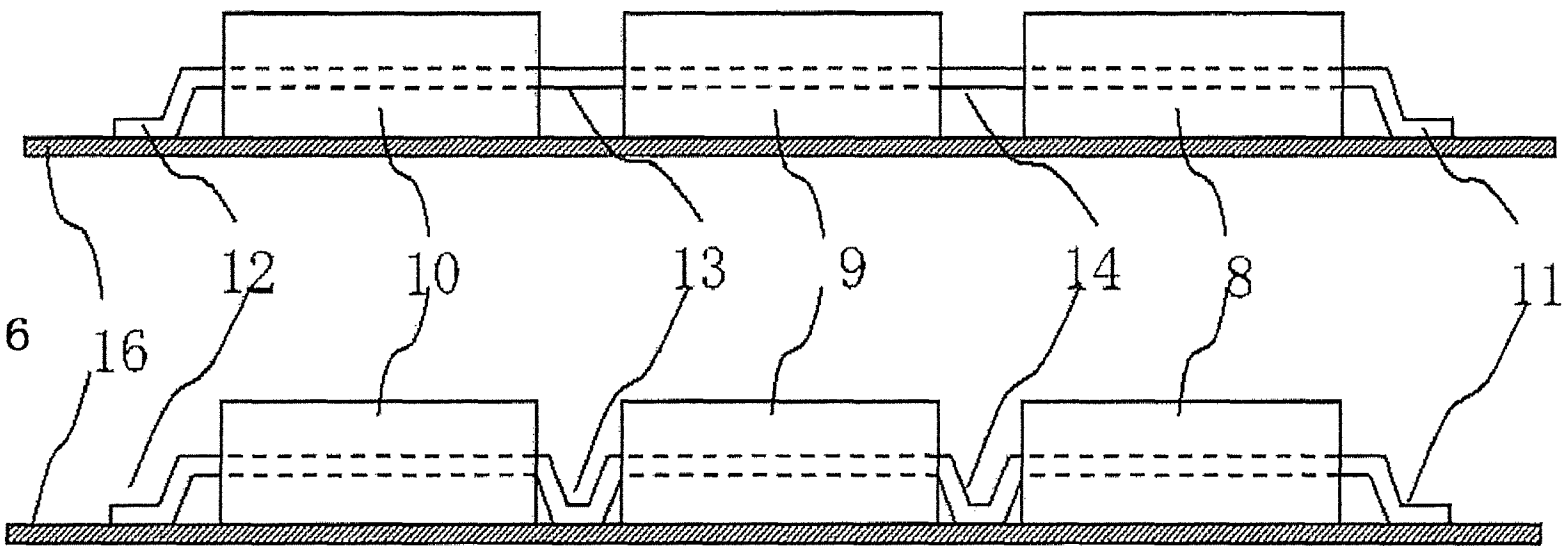
FIG. 6 is a figure showing the connected state of the chip antenna concerning this invention.

As mentioned above, in the structure shown in FIGS. 1 and 2, said each conductor and said each connection conductor comprise one lead wire. Therefore, the conductor portion protruding from the other end, to which electric supply is not carried in magnetic base 8, and the conductor portion protruding from one end, to which electric supply is carried in magnetic base 10, are common, furthermore, these are common also in the connection conductor 13. The protruding portion in the above-mentioned conductor and the above-mentioned connection conductor do not need to be common. For example, the conductor which penetrated the 1st magnetic base 10 and has been protruded from the end to which electric supply is carried, and the conductor which has penetrated and protruded from the 2nd magnetic base 8, may be connected, using the connection conductor composed of different parts from the above-mentioned conductor. Moreover, the electrode formed on the substrate as shown in FIG. 6 can be used as a connection conductor which composed of this different part. The above-mentioned protruding conductor portion can be connected to this electrode with solder. However, if said each conductor and said each connection conductor are formed and united as a linear conductor, the number of these connections can be reduced. Therefore, the manufacturing process in a chip antenna or communication equipment can be simplified, also the reliability of the product can be raised. If it is a case where the chip antenna of FIG. 2 is used, a chip antenna is mounted in a substrate and other end 12 of conductor 7 of said 1st chip antenna element constitutes an open end. On the other hand, one end 11 of said 2nd chip antenna element is connected to control circuits (not shown), such as a feeder circuit, and an antenna device is constituted.

Figure 4:
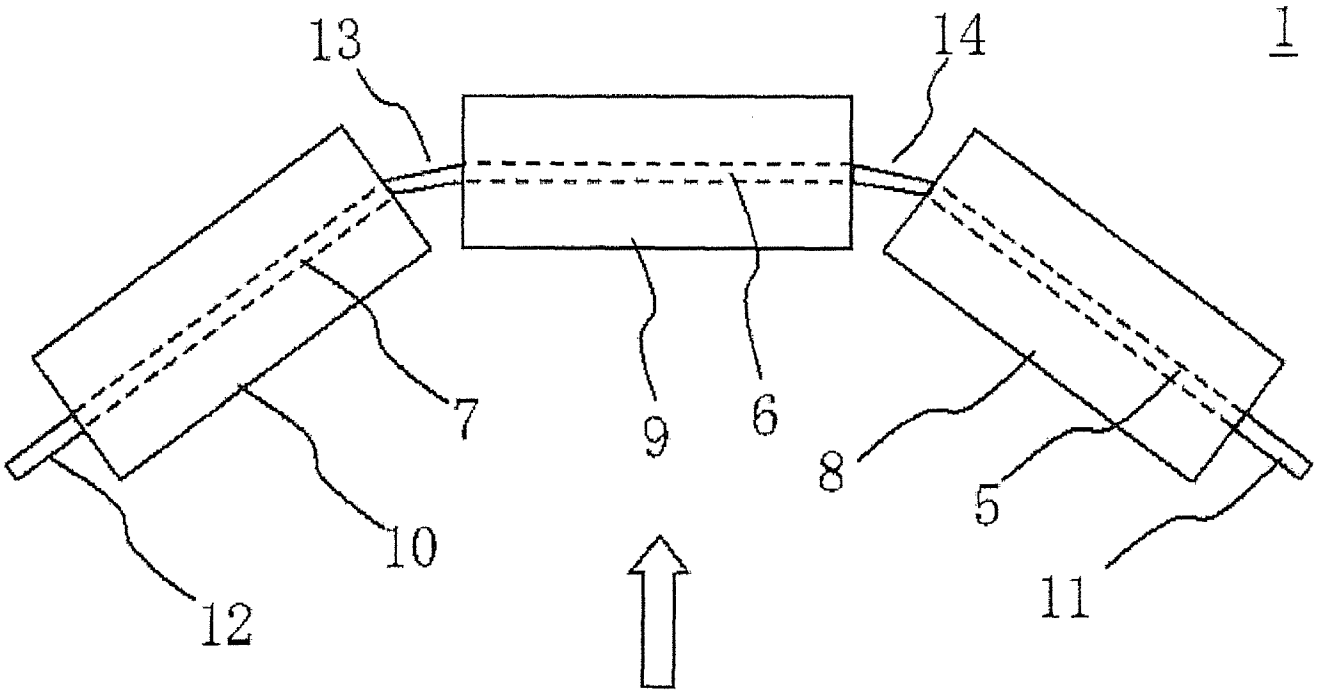
FIG. 4 is a figure showing the chip antenna of other embodiments of this invention.
Figure 4:
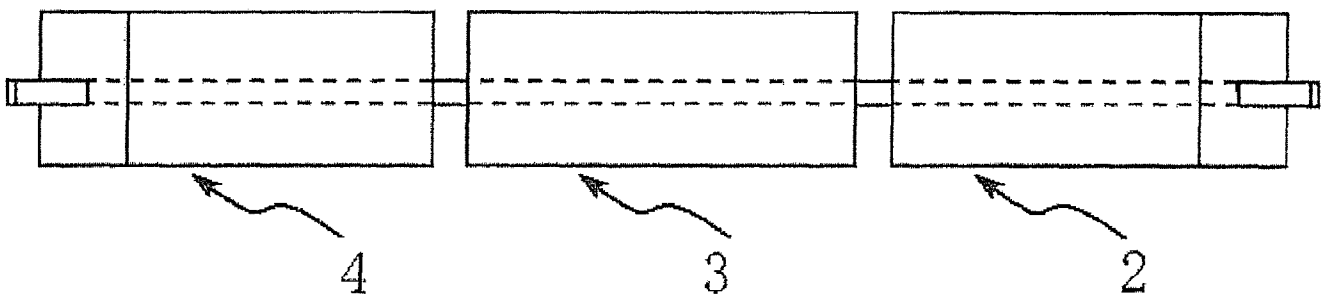

Next, an example of other embodiments of the chip antenna concerning this invention is shown in FIG. 4. Chip antenna 1 in FIG. 4 is provided with two or more said 2nd chip antenna element (chip antenna element 2 and chip antenna element 3). Conductors 5 and 6 of each other in these 2nd chip antenna elements, are connected in series by connection conductor 14 arranged among said two or more 2nd chip antenna elements. In the example shown in FIG. 4, conductor 7 of the 1st chip antenna element 4 has penetrated the 1st magnetic base 10. However, conductor 7 does not need to penetrate magnetic base 10. The other end of conductor 7 may exist in the core of magnetic base 10 like the case of the example shown in FIG. 1, to have penetrated is more desirable. (a) in FIG. 4 is a top view (it corresponds to the figure seen from the upper part perpendicular to the substrates face in the case of being mounted in the substrate). (b) is the front view seen from the arrow direction in (a).

In the chip antenna shown in FIG. 4, it has three chip antenna elements 2, 3, and 4. A chip antenna element has magnetic bases 8, 9, and 10 and conductors 5, 6, and 7 formed in the core, respectively. These are mutually connected in series by connection conductors 14 and 13, and these conductors 5, 6, and 7 are electrically connected. In the composition of FIG. 4, each conductor takes linear shape. Each magnetic base in rectangular parallelepiped shape is penetrated along with a longitudinal direction. The conductor part of the chip antenna in FIG. 4 comprises a linear conductor with which said each conductor and said each connection conductor are united. This structure can also be regarded as the structure where the magnetic base is trichotomized, in one chip antenna with which the linear conductor was embedded at the magnetic base. In this structure, the both sides of each conductor have protruded from the magnetic base. The both sides of each conductor do not need to protrude, like the case of the embodiment shown in FIGS. 1 and 2. In this case, the exterior electrodes which make connection with said conductor are required. For example, as shown in FIG. 6 in this case, the exterior electrodes in one chip antenna element are connected by solder to the electrode formed on the substrate with the exterior electrodes in other chip antenna elements, here, chip antenna elements are connected in series.

As mentioned above, said each conductor and said each connection conductor are constituted from the structure shown in FIG. 4 by one lead wire. Therefore, the conductor part protruding from the other end in magnetic base 8, to which electric supply is not carried, and the conductor part protruding from one end of magnetic base 9, are common, these portions serve also as connection conductor 14. Similarly, the conductor part protruding from the other end in magnetic base 9, and the conductor part protruding from one end in magnetic base 10, to which electric supply is carried, are common, these portions serve also as connection conductor 13. The protruding portion in the above-mentioned conductor and the above-mentioned connection conductor do not need to be common. For example, the conductor which has penetrated the magnetic base and has been protruded from the end, and the conductor which penetrated other magnetic base and has been protruding from the end of the other magnetic base, may be connected with said connection conductor composed of different parts from the above-mentioned conductor. Moreover, the electrode formed on the substrate as shown in FIG. 6 can be used as a connection conductor which composed of this different part. The above-mentioned protruding conductor portion can be connected to this electrode with solder. Or the substrate having two or more through holes and the electrode which has electrically connected it can be used. Here, conductors are connectable by inserting said protruding conductor part in said through hole, and connecting by solder.

According to this method, a chip antenna can be more firmly fixed on the substrate used within communication equipment. However, if said each conductor and said each connection conductor are formed and united as a linear conductor, the number of these connections can be reduced. Therefore, the manufacturing process in a chip antenna or communication equipment can be simplified, also the reliability of the product can be raised.

It is also possible for the number of said 2nd chip antenna elements not to be limited to 1 or 2, and to carry out to three or more. Length along the longitudinal direction of the 2nd chip antenna element may be shortened, the number may be increased, and two or more chip antenna elements may be connected in the shape of a rosary. Since ceramics are used as a base, a magnetic material chip antenna may break, when a strong impact is given. In communication equipment, especially portable communication equipment, an impact is given by fall in many cases. Therefore, in order to improve the reliability of a chip antenna, higher shock resistance is required. If a magnetic base is shortened along a longitudinal direction, the reliability of the magnetic base against the shock can be improved. For example, the relation of the bending strength S to the maximum load N is $S=3Nd/(2\,wt^2)$, where w is width, t is the thickness, d is the distance between fulcrums. Therefore, the maximum load becomes $N=2Swt^2/(3d)$, and is proportional to the ratio of width to the distance between fulcrums. When communication equipment falls, the direction of the external force given to a chip antenna, is not regular. Therefore, a cube is ideal shape in order to acquire the strength. in this case, w/d, the ratio of width to the distance between fulcrums (here, it is equivalent to the length of a magnetic base), is 1. In the chip antenna concerning this invention, it can be considered as the structure divided into two or more chip antenna elements. Therefore, this w/d can be set to almost 1, and the strength can be raised. For example, the frequency ranges in the digital terrestrial broadcasting in Japan are 470 MHz-770 MHz. These ratios w/d can be made into ⅕ or more as a magnetic material chip antenna for these frequency ranges. This ratio can be more preferably made into ⅓ or more, and the strength can be raised.

Figure 5B:
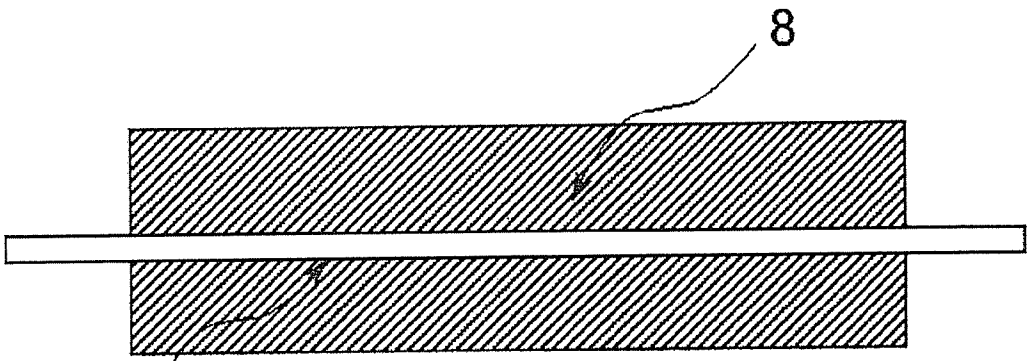
FIG. 5 is a figure showing the example of the chip antenna element used for the chip antenna of this invention.
Figure 5C:
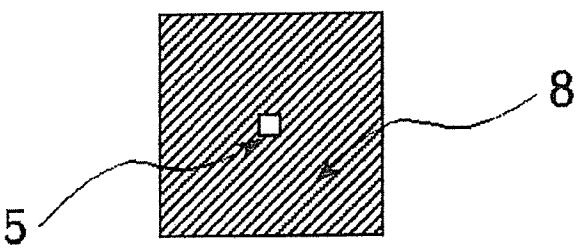
Figure 5A:
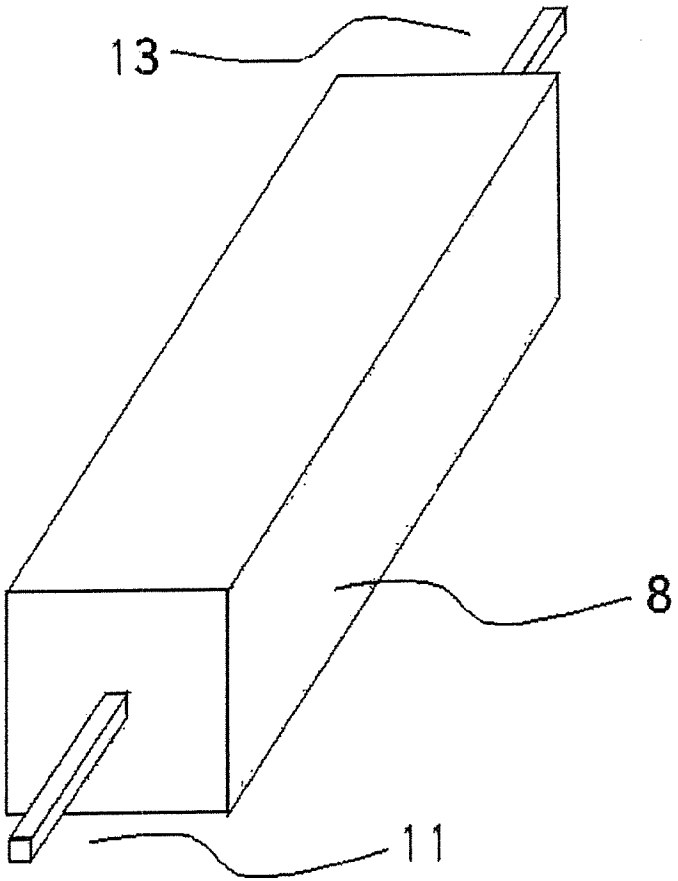

Next, each chip antenna element is explained below. An example of the chip antenna element which constitutes a chip antenna is shown in FIG. 5. (a) in FIG. 5 is a perspective view. (b) is the sectional view which contained the conductor along with the longitudinal direction. (c) is a sectional view along a direction perpendicular to a longitudinal direction. The structure shown in FIG. 5 is an example of the 2nd chip antenna element. Conductor 5 taking linear shape has penetrated rectangular parallelepiped-like magnetic base 8 along with the longitudinal direction. Conductor 5 of linear shape is formed along surfaces, such as the side face of a rectangular parallelepiped, or a cylindrical peripheral face, of the base outside in which it is located, so that the conductor may be surrounded. This conductor 5 penetrates the magnetic base between both side faces along the longitudinal direction. In the core of this magnetic base, it is more preferred that there is no conductor part in the perpendicular direction to the direction along this line conductor. With the structure in FIG. 2, the both ends of said conductor, i.e., one end 11 and the other end of a conductor, have protruded from magnetic base 8. Inside of magnetic base 8, only straight shape conductor 5 exists as a conductor part. Therefore, it becomes the structure where the capacity component was reduced. Since it is the structure which this one conductor taking the linear shape which functions as a radiation conductor has penetrated, this conductor does not have a portion which counters substantially inside the base. Therefore, it is effective in especially reduction of a capacity component. Therefore, as for the number of the conductors which penetrate a magnetic base, one is preferred. However, the interval between lead wire is wide enough, and when the influence of a capacity component is small, it is also possible to set the structure where other conductors penetrate the base, or other conductors are formed inside the base.

When the length of the conductor inside a magnetic base is the same, the whole chip antenna element can be miniaturized compared with the case where this conductor has not penetrated. In the both ends of straight shape conductor 5, electric connection to other chip antenna elements, circuit elements, or electrodes, is possible. Therefore, the flexibility in a design is high. It is preferred for the conductor taking linear shape, to penetrate the base, keeping the distance constant from faces of the base outside such as the side face of a rectangular parallelepiped, or a cylindrical peripheral face, by which the conductor may be surrounded. In the structure shown in FIG. 5(*a*), conductors 5, 6, and 7 taking linear shape penetrate this magnetic base in the center along the longitudinal direction of magnetic bases 8, 9, and 10. In a section perpendicular to the longitudinal direction of magnetic bases 8, 9, and 10, conductors 5, 6, and 7 taking linear shape are located in the center.

Figure 3:
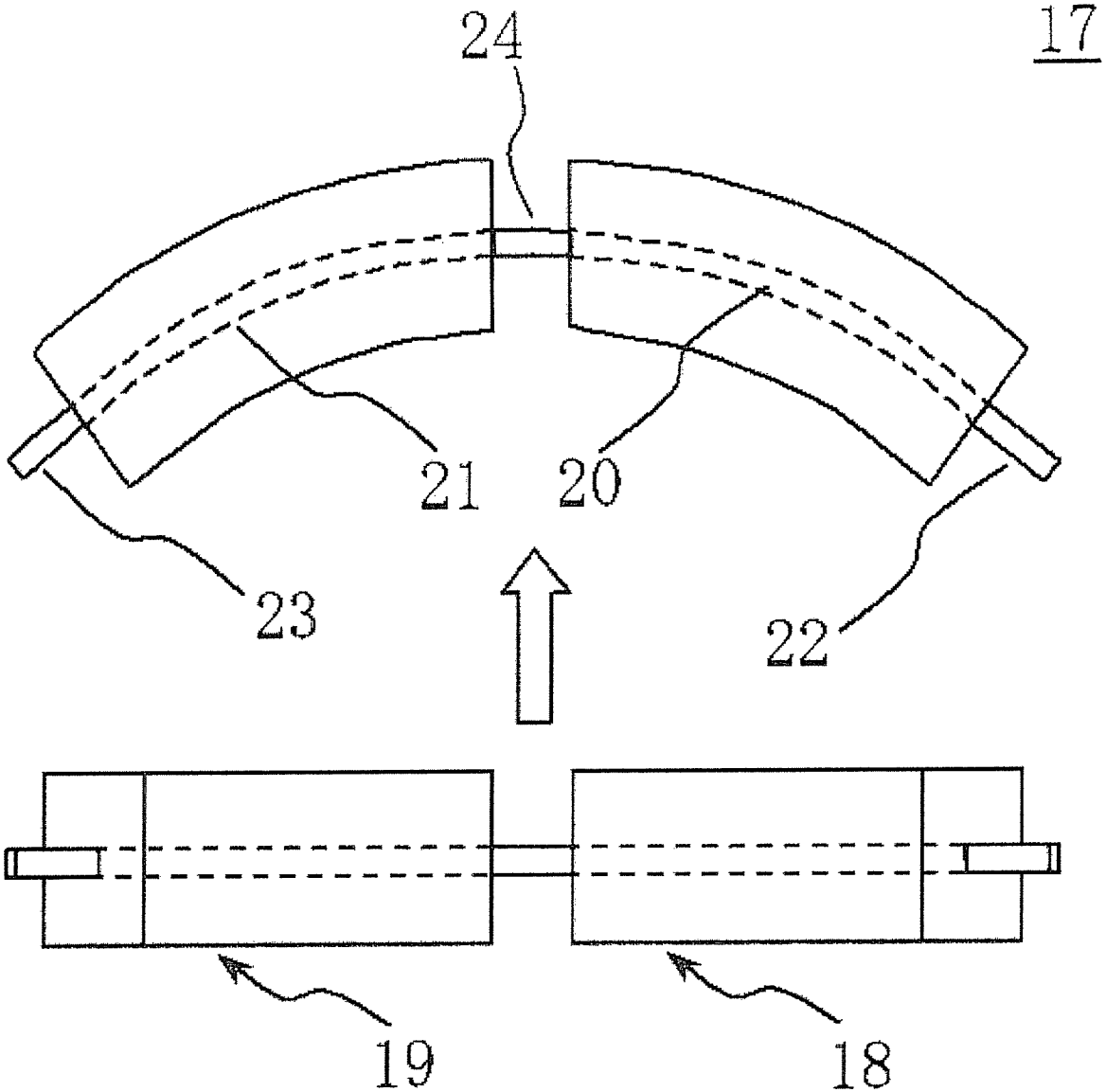
FIG. 3 is a figure showing the chip antenna of other embodiments of this invention.

As shown in FIG. 3, the structure where linear conductors 20 and 21 penetrate said magnetic base along with the longitudinal direction of the magnetic base, is also made. (a) in FIG. 3 is a top view (corresponding to the figure seen from the upper part perpendicular to a substrates face in case the chip antenna is mounted in the substrate). (b) is the front view seen from the arrow direction of (a). Inside the base, a conductor constitutes neither a coil nor a meander shaped electrode by the structure where the linear conductor is formed along the longitudinal direction of the magnetic base. It is preferred not to have a bended section in a longitudinal direction. In the chip antenna element which constitutes chip antenna 17 in FIG. 3, linear conductors 20 and 21 penetrate along the arch shaped base. According to this composition, shape of the whole chip antenna can be made into smoothly curved shape. Therefore, it is possible to fit this shape to mounting space. The linear conductor was formed along fields of the base outside in which it is located so that a conductor may be surrounded, such as the side in a rectangular parallelepiped, and a peripheral face in a cylinder, and has penetrated between the both-ends sides of a base longitudinal direction. In this case, it is preferred for the conductor to keep the distance constant from the field of the base outside in which it is located so that this conductor may be surrounded. A conductor is located at the center of the section of a circular base in FIG. 3. With the structure in FIG. 3, the both ends of the conductor, i.e., one end 22 and other end 24 of a conductor, have protruded from the magnetic base. As for the portion except the magnetic base and the conductor taking arc shape, an antenna device and communication equipment are constituted like the case of FIG. 2.

Next, the advantage of the chip antenna concerning this invention is explained. In order to make bandwidth wide, it is necessary to lower the Q value of an antenna. However, since a Q value is expressed with $(C/L)^{1/2}$, here L is the inductance, and C is the capacitance, so C must be raised, and C must be lowered. When dielectrics are used as a base, in order to raise inductance L, it is necessary to increase the number of turns of a conductor. However, since the increase in the number of turns causes the increase in line capacity, it cannot lower the Q value of an antenna effectively. On the other hand, in this invention, since a magnetic base is used as a base, inductance L can be raised by raising magnetic permeability, not by raising the number of the turns of a conductor. Therefore, the increase in the line capacity by the increase in the number of turns can be avoided, and a Q value can be lowered. Therefore, bandwidth of an antenna can be made wide. In particular, in this invention, the chip antenna element having the effective structure for capacitance reduction, in which the conductor taking linear shape penetrates a magnetic base as mentioned above, is used. Therefore, an effect especially remarkable in making bandwidth of a chip antenna wide is demonstrated. In this case, a magnetic path is formed in a magnetic base so that the conductor 5 may be gone around. Therefore, a closed magnetic path is constituted. Inductance component L obtained with this structure depends on the length or the cross-sectional area of the portion of the magnetic base, which cover the conductor 5. Therefore, when the conductor taking linear shape does not penetrate magnetic base 8, the portion which does not contribute to inductance component L increases. Therefore, it is preferred to lessen this portion. By the chip antenna concerning this invention, an inductance component can be obtained efficiently, since conductor 5 penetrates magnetic base 8 in this chip antenna element. Therefore, a chip antenna can be miniaturized.

As mentioned above, the magnetic path in the chip antenna element concerning this invention is formed so that conductor 5 may be gone around. Therefore, even if the magnetic base is divided along the longitudinal direction of the conductor, the influence made by the division on the inductance component L, is very small theoretically. Therefore, a magnetic base is divided and a chip antenna can be constituted. On the other hand, when a helical electrode is formed in a magnetic base, since the magnetic path inside a magnetic base is formed along the shaft orientations (longitudinal direction of a magnetic base) of a coil, if this magnetic base is divided, L component falls remarkably. Therefore, when a helical electrode is formed in a magnetic base, the chip antenna with which the magnetic base was divided simply cannot be constituted.

The management of wiring in the exterior of the magnetic base can be taken by forming a printed electrode on a magnetic base, and the fixation can be taken by soldering with the printed electrode concerned. In order to simplify a manufacturing process and to suppress the increase in capacity, it is preferred to manage the wiring for soldering etc. using the protruding end of the conductor. As for this printed electrode, when management of wiring outside of this magnetic base is done by this printed electrode, it is desirable to make that area and an opposite portion as small as possible. Like the structure in FIG. 4, when the both ends of conductors 5, 6, and 7 have protruded, solder fixation of chip antenna 1 can be performed by one end 11 (henceforth the 1st end) of conductor 5, and other end 12 (henceforth the 2nd end) of conductor 7, and stable mounting is attained. The protruding end may not be taken straight shape, and may be bended. The example in which chip antenna 1 was mounted to the substrate is shown in FIG. 6. In the structure shown in (a) in FIG. 6, one end 11 of said conductor 5 and other end 12 of conductor 7 are bended toward the mounting surface side of magnetic bases 8 and 10 in the portion set apart from magnetic bases 8 and 10 respectively, so that it may be easy to mount in the substrate. The end part of these conductors is located in parallel with the bottom face, which is the end surfaces of a magnetic base, or concretely, is located on same plane as the bottom face. Since the bended portion is set apart from the end face of a magnetic base, the increase in capacity decreases. The scratch of the magnetic base, or damage to the conductor near the boundary of a conductor and a magnetic base, decreases. Connection conductors 13 and 14 which serve as the protruding end on the other hand, are made into linear shape. One end 11 of said conductor 5 and other end 12 of conductor 7 are connected to the conductor part formed in the substrate with solder etc. (b) in FIG. 6 is an example for which connection conductors 13 and 14 are also bended toward the mounting surface side of magnetic bases 8 and 10. As one end 11 of said conductor 5, and other end 12 of conductor 7, it is preferred to set apart the bended portion of these connection conductors from the magnetic base.

In any case, when managing wiring at the protruding end, since it is not necessary to form an electrode on the surface of the magnetic base, the increase in a capacity component can be suppressed. Like the embodiment shown in FIG. 4, this conductor does not have a portion which counters in the core and on the surface of a magnetic base with the structure where the protruding portion takes linear shape. Therefore, a capacity component can be suppressed.

Figure 8:
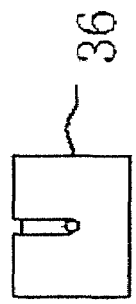
FIG. 8 is a figure showing the chip antenna of other embodiments of this invention.
Figure 8:
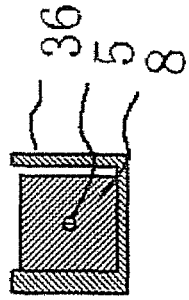
Figure 8:
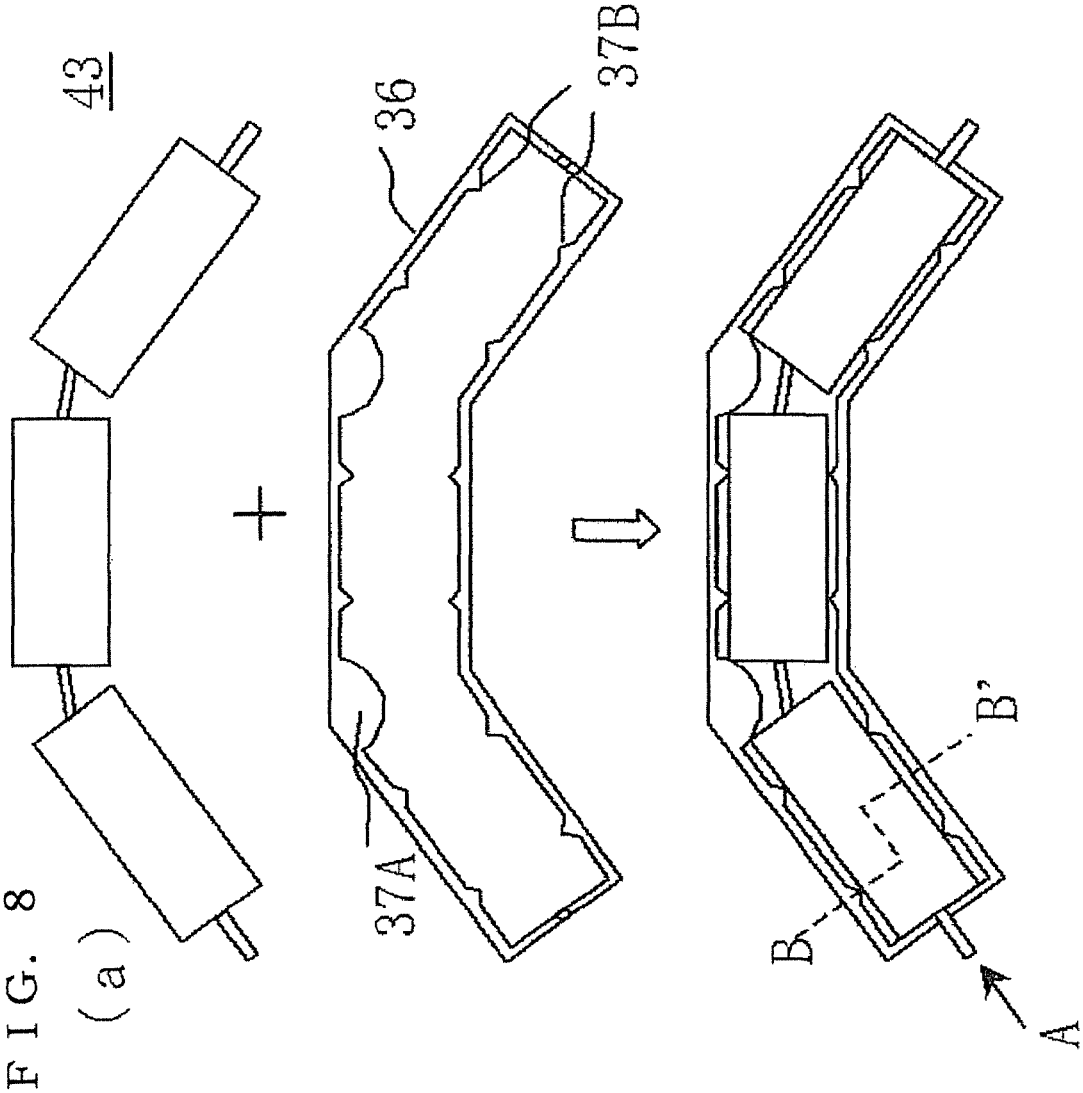

Next, other embodiments of the chip antenna concerning this invention are shown in FIG. 8. In the example shown in FIG. 8, chip antenna 43 provided with the 1st chip antenna element and 2nd chip antenna element is accommodated in one case 36. (a) in FIG. 8 shows the top view of chip antenna 43, case 36 made of resin where the chip antenna is accommodated, and said chip antenna 43 accommodated in said case 36. (b) in FIG. 8 is the side elevation seen from the direction of A in (a) of FIG. 8. (c) in FIG. 8 is a sectional view in the B-B' line in (a) of FIG. 8. Case 36 has the space in which a chip antenna element can be accommodated along a depth direction. Slits are formed on both side face of case 36, from upper side to the center on the side face, so that linear conductor 5 may be taken out from inside to outside of the case. A through-hole may be formed instead of a slit. It is not necessary to provide said slit or said through-hole in both side surfaces, and it may be provided in the side of one side. Protrusion 37A which restrains a motion along the longitudinal direction of a chip antenna element, is formed in the side face inside case 36, between chip antenna elements. A chip antenna element is restrained between this protrusion 37A and the end face inside of the case. Protrusions 37B which restrain a motion of the each chip antenna element along perpendicular direction to the longitudinal direction of the chip antenna element, are formed on inner wall of the case at two points. In the example of FIG. 8, said protrusions 37A and 37B are formed in the depth direction pillar-shaped, and restrain a chip antenna element with the pillar. Although the section shape in particular of a pillar-shaped protrusion is not limited, it can be taken, for example, shape of a triangle, semicircular state, etc. A punctiform protrusion may be used instead.

Instead of forming these protrusions, space equal to the shape of a chip antenna element may be provided, and this space may be equipped with a chip antenna element. It is also possible to restrain a motion of the chip antenna element using the plate-like case where the protrusion is formed. The depth of a case is not limited in particular. In order to protect magnetic base 8, this thickness is larger than the thickness of a magnetic base, and it is preferred that a magnetic base does not protrude from the case upper surface. A chip antenna element may be fixed to a case with adhesives. In the chip antenna concerning this invention, since two or more chip antenna elements are used, physical relationship is changeable. However, it becomes possible by adopting the structure using said case to hold the physical relationship of two or more chip antenna elements.

Figure 9:
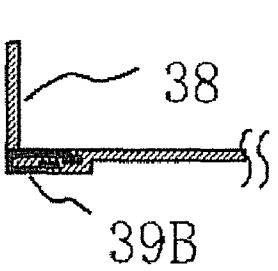
FIG. 9 is a figure showing the chip antenna of other embodiments of this invention.
Figure 9:
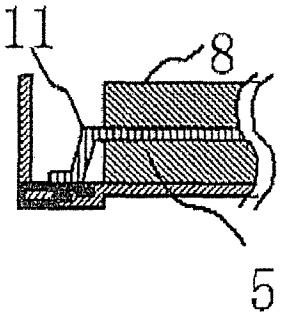
Figure 9:
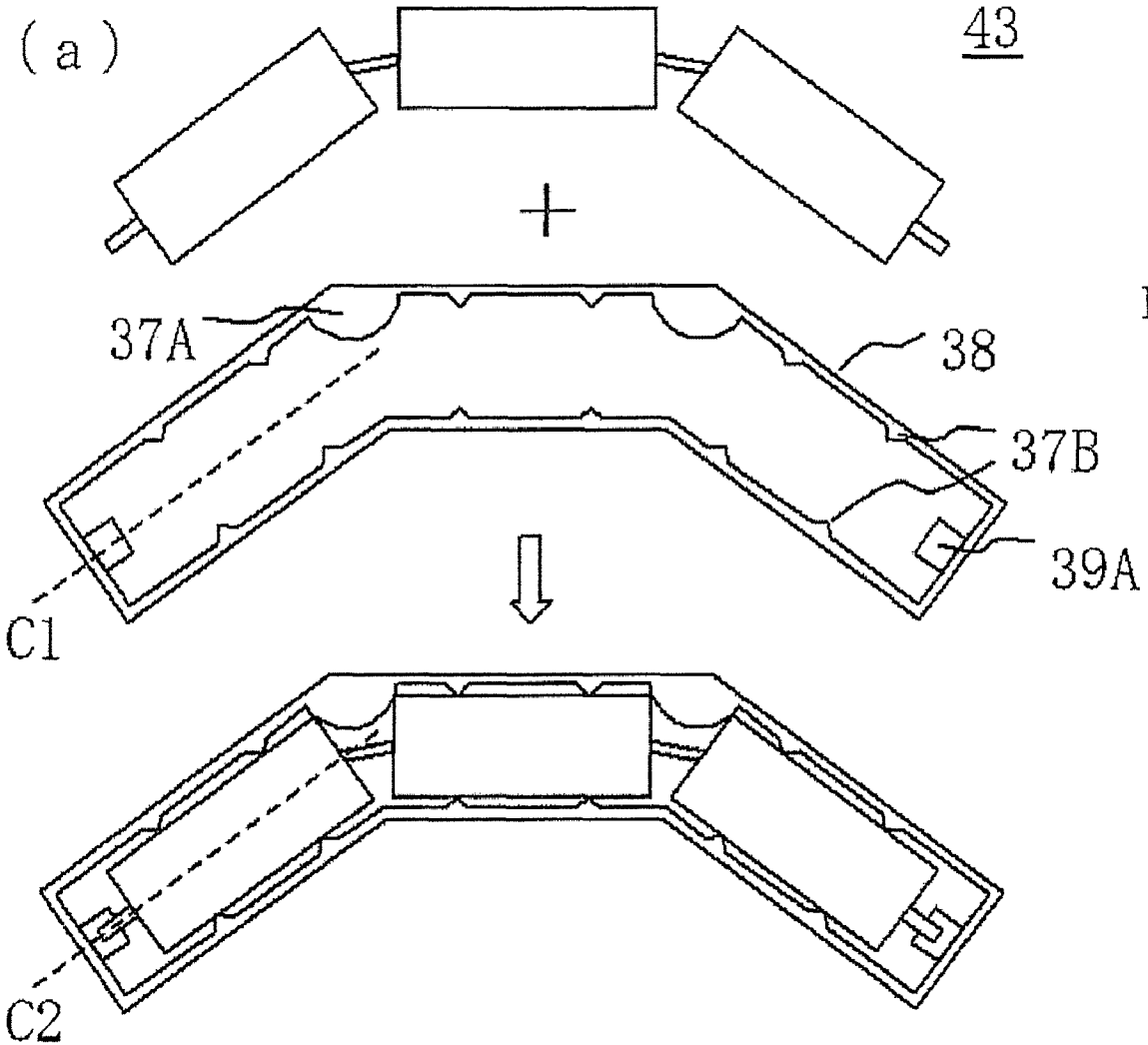

Another embodiment of the chip antenna in which the 1st chip antenna element and 2nd chip antenna element are accommodated in one case, is shown in FIG. 9. The composition of protrusions 37A and 37B is the same as that of the embodiment shown in FIG. 8. According to the embodiment shown in FIG. 9, the conductor member is formed on the outer side face of case 38. Conductor member 39B is formed, from lower end in the center on both side face, to both end on bottom face. The conductor part in a substrate etc. and this case can be connected using this conductor member, and a chip antenna can be fixed. With the structure shown in FIG. 9, conductor member 39B is further formed from the case to inside, and conductor member 39A is formed inside. Therefore, conductors 39A and 39B are united, and conduction is taken electrically. The end of conductor members 39A and 39B is interpolated inside of a resin case. For example, this case can be formed after molding the conductor member made of phosphor bronze, using resin. In the example shown in FIG. 9, conductor member 39A connected to conductor member 39B formed on the outer face of the case, is formed at the both ends of the bottom of the case inside. This conductor in a chip antenna element is connected to this conductor member 39A by solder (not shown)—With this structure, fixation of a chip antenna and electric connection of a chip antenna, other circuits, etc. can be made using said conductor member 39B. Although conductor member 39B is formed along the face of the outside of case 38, this conductor member may be made to protrude from a case as an electrode pin structure in the example shown in FIG. 9.

Figure 10:
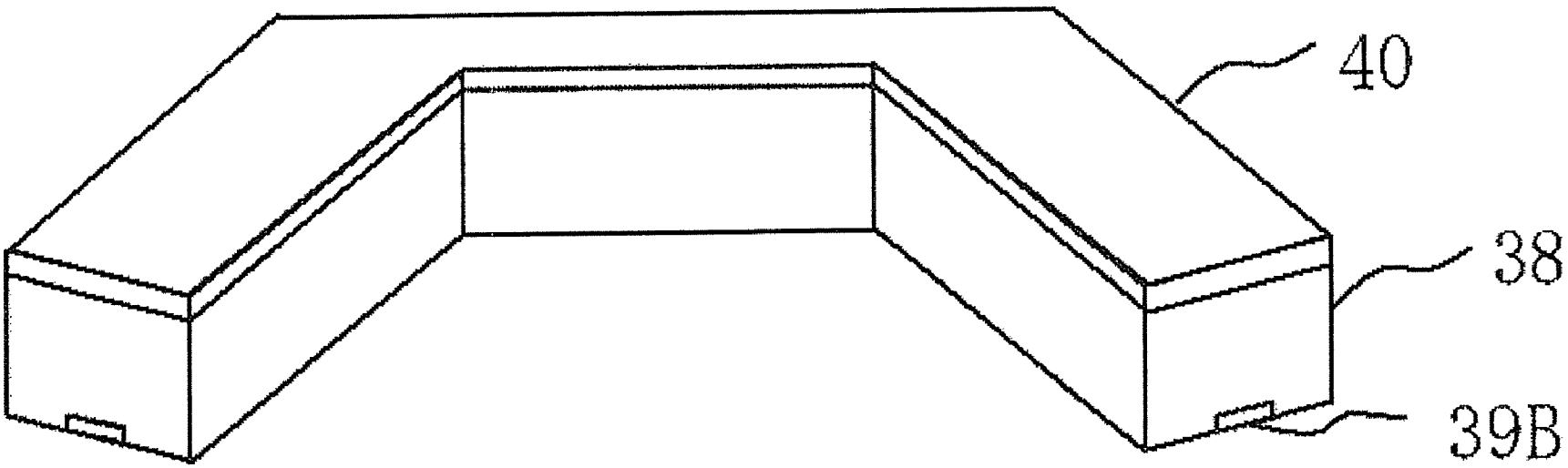
FIG. 10 is a figure showing the chip antenna of other embodiments of this invention.

Using the metal plate on which the slit is formed from the upper part, can be formed from a bottom side of the case instead of conductor member 39A, and the linear conductor protruding from the magnetic base can also be supported by this metal plate. In this case, it is preferred to make this metal plate united with said conductor member 39B, or to connect them electrically. If width of said slit is made smaller than the width or the path of said linear conductor, fixation and electrical connection of a chip antenna element can be performed simultaneously. The width of a slit may gradually decrease along a depth direction. Width of the upper limit of a slit may be made smaller than the width of the middle portion where the conductor is inserted, so that the slit hangs the conductor. Conductor member 39A of a case interior is not needed. If the conductor member is formed in lateral surfaces of the case, such as the side and the bottom, it is possible to mount the chip antenna connected to conductor parts on the substrate, and to accommodate the chip antenna in the case. In this case, the electrical connection can be made by taking out the conductor protruding from the magnetic base, from the case. Lid member 40 may be formed in the case upper part. FIG. 10 is a perspective view of the structure where lid member 40 is formed in the upper part of case 38 which accommodates the chip antenna. The lid member is fixed by adhesives. Or the lid member may be hung on a case. The whole chip antenna element can be protected by providing the lid member. In addition to formation of an above-mentioned protrusion, or instead, a motion of the chip antenna element may be restrained using said lid member.

The above are examples which restrains a motion of the chip antenna element using the case. Instead of using a case, the molding the chip antenna element with resin, can be applied. For example, the chip antenna shown in FIG. 4 can be inserted into a die, be filled up with resin, and can be molded with resin, and chip antenna is obtained. In this case, the conductor protruding from the magnetic base is taken out to the outside of resin.

Next, the member which constitutes a chip antenna is explained. The material of a conductor is not limited in particular. For example, alloys, such as 42 alloy, covar, phosphor bronze, brass, and the Corson copper alloy, besides metal such as Cu Ag, Ni, Pt, Au, and Al, are used. Among these, a soft material such as Cu etc. is suitable for the conductor which is bended at both ends. Hard material such as 42 alloy, covar, phosphor bronze, and the Corson copper alloy, is suitable for the conductor when the magnetic base is fixed firmly, or the conductor is not bended. Insulating cover layers, such as polyurethane and enamel, may be formed on the conductor. For example, when the magnetic base with high volume resistivity , such as higher than $1\times10^5$ Ω·m, is used, the insulating cover layer is not needed. However, high insulation is especially acquired by forming an insulating cover layer. In this case, as for the thickness of this cover layer, 25 micrometers or less are preferred. If this becomes thicker, the gap between the magnetic base and the conductor will become large, and an inductance component will decrease.

The shape of a magnetic base is not limited in particular. The rectangular parallelepiped shape whose section takes rectangle or square shape, or cylindrical shape, etc. can be used. For stable mounting, rectangular parallelepiped shape is preferred. In the case of rectangular parallelepiped shape, it is preferred to form beveling in the portion of the corner located in the direction perpendicular to a longitudinal direction. Magnetic flux becomes hard to leak with this beveling, and chipping etc. can be prevented. This beveling may be carried out with straight shape or with forming radius of curvature. The width (length lost by the beveling portion in the side of the magnetic base) of beveling, is preferred to be set to 0.2 mm or more, to obtain the effect. On the other hand, since stable mounting will become difficult even if it is rectangular parallelepiped shape, if beveling becomes large, 1 mm or less (⅓ or less of the width of a magnetic base or height) is preferred. If the length, width, or height of the magnetic base become large, resonance frequency will fall. The sum of the length along the longitudinal direction of the magnetic base in each chip antenna element, is preferred to be set to 30 mm or less. The length of the magnetic base of each chip antenna element may not be the same. However, if these are the same, manufacturing process are simplified. It is preferred that the width of a magnetic base is set to 10 mm or less, and the height is set to 5 mm or less. If the dimension of the base exceeds these ranges, it will enlarge as a surface mount type chip antenna. For example, the frequency range in digital terrestrial broadcasting is 470-770 MHz. In order to use this chip antenna in this frequency range, the resonance frequency is set to around 550 MHz. In this case, it is more preferred that the sum of the length is set to 25-30 mm, the width is set to 3-5 mm, and the height is set to 3-5 mm in the magnetic base.

The section shape of a conductor is not limited, in particular. For example, shape, such as circular, a rectangle, and a square, can be used. The conductor taking shape of a wire or a tape, can be used. If the section shape of the conductor and the section shape of the magnetic base are similar, the thickness of the magnetic base which surround the conductor will become almost constant. In this case, since a homogeneous high magnetic path is formed, it is desirable. Here, the section means a section perpendicular to the longitudinal direction of said magnetic base. For example, when the straight shape conductor penetrates the magnetic base taking rectangular parallelepiped or cylindrical shape, along the longitudinal direction, in a section perpendicular to this longitudinal direction, the magnetic base encloses the conductor. The section means a section perpendicular to the circumference of the circle, i.e., a section cut in the diameter direction of a circle when a magnetic base is taking curved shape, such as circular shape or arch shape. Also in this case, this magnetic base encloses this conductor in this section.

The structure where the straight shape conductor has penetrates the magnetic base shown in FIG. 5 is explained further in full detail. In this structure, the magnetic base and the conductor may be formed as one. For example, it can be formed by the method currently indicated by the 1st document. Here, the conductor is arranged in the powder of a magnetic material, compression molding is carried, and it is sintered after that. Sintering time will become short if microwave sintering is used as sintering besides the usual heating, in this case, the reaction of the conductor and the magnetic powder can be suppressed. The lamination process of laminating a green sheet is also used as a method of forming the magnetic base and the conductor as one.

Sheet forming of the mixture of magnetic powder, a binder, and a plasticizer is carried out by the doctor blade method etc., and a green sheet is obtained. This green sheets are laminated and a laminated sheet is obtained. Conductive paste, such as Ag, Ag—Pd, and Pt, is printed at straight shape on the green sheet which will be located in the center section of this laminated sheet. By this method, the magnetic base which the straight shape conductor penetrates can be obtained. However, in order to take the connection to said conductor taking linear shape and to manage the wiring outside the magnetic base, it is necessary to form a surface electrode on the surface of a magnetic base by printing, baking, etc.

On the other hand, a magnetic base and a conductor may be formed independently. In this case, as composition of a chip antenna, a through-hole is provided in a magnetic base and a conductor is formed into this through-hole. When forming a magnetic base and a conductor independently, the influence of the reaction between a magnetic base and a conductor can be eliminated. Therefore, the flexibility of a design and the accuracy of dimension of a conductor can be raised. When a magnetic base is formed with ferrite ceramics, this magnetic base can be produced by the usual powder-metallurgy technique. As a method of forming a through-hole in this magnetic base, the method of forming a through-hole by machining can be used. The molded object having a through-hole in it by the compression molding method or an extrusion-molding method, may be produced, and this may be sintered. When producing a long magnetic base, two or more short magnetic bases may be accumulated making through-holes counterpose. The magnetic base which comprised a curved surface as shown in FIG. 3 can also be produced by the compression molding method or an extrusion-molding method. It may be processed in the state of ceramics, and also may be processed in the state of a molded object, preferably.

The section shape of a through-hole is not limited in particular. For example, this shape can be set to circular and a quadrangle. In order to make insertion of a conductor easy and to make the interval of a magnetic base and a conductor small, it is preferred to make section shape of a through-hole similarity with the section shape of a conductor. Although a gap may be between a magnetic base and a conductor, inductance decreases by existence of this interval. Therefore, it is desirable for this gap to be small enough to the thickness of a magnetic base. As for this gap, it is preferred that it is 50 micrometers or less at one side. It is preferred that the section shape of a through-hole and the section shape of a conductor are almost the same in the state which a conductor can insert in this through-hole. It does not depend for the above matter on the formation method of a through-hole.

Figure 7B:
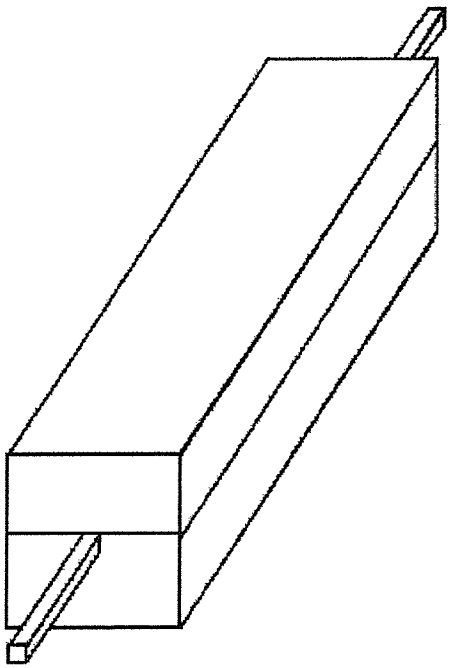
FIG. 7 is a figure showing the example of composition of the chip antenna element used for the chip antenna of this invention.
Figure 7A:
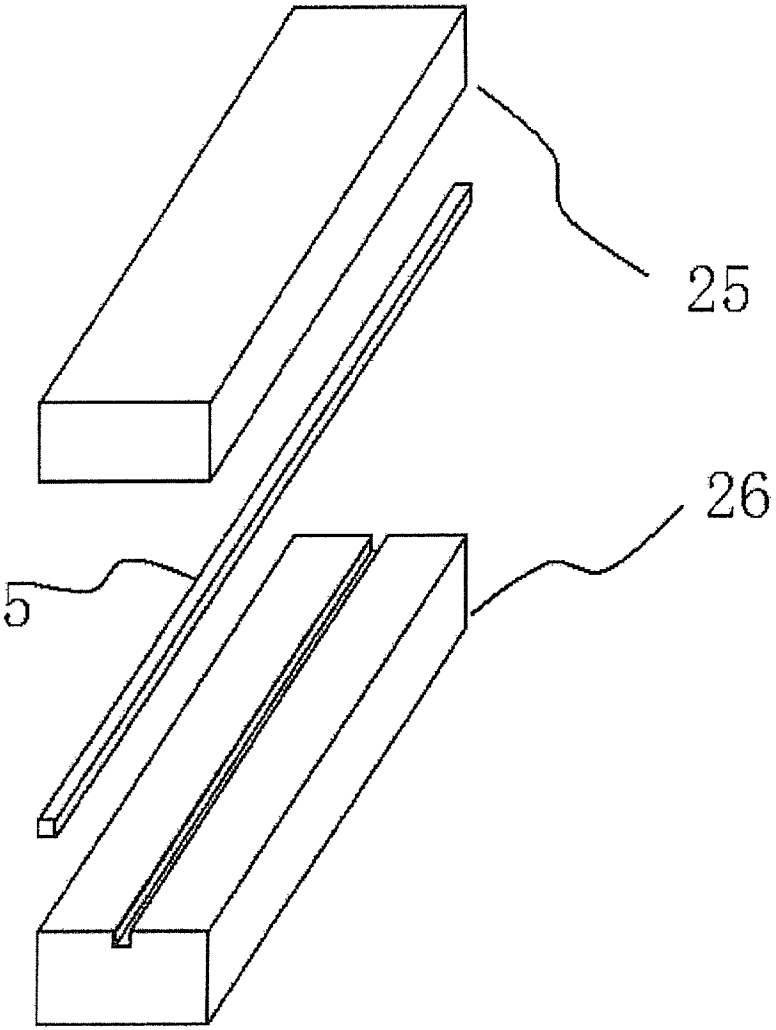

An example by which composition shown in FIG. 5 using the magnetic base and conductor which were formed separately was realized, is shown in FIG. 7. The example shown in FIG. 7 is an embodiment in which a rectangular parallelepiped-like magnetic base comprises two or more members, and the through-hole is formed of the combination of two or more of said members. At (a) in FIG. 7, the magnetic base comprises magnetic member 26 in which the slot was established in order to insert a conductor, and magnetic member 25 for pasting together to this magnetic member 26 across this slot. Conductor 5 is inserted in the slot of magnetic member 26, and also magnetic member 25 is pasted together, and it fixes, and becomes a chip antenna (FIG. 7(*b*)). A conductor may be inserted in the formed through-hole after pasting magnetic member 26 and magnetic member 25 together. A through-hole is formed by pasting magnetic member 26 and magnetic member 25 together in both cases. These slots can be formed with sufficient accuracy, if a dicing process is used, for example. In the example of FIG. 7, since a member is pasted together and it finishes setting up a base after performing easy slot processing, a through-hole can be formed very simply. The section shape of a slot is determined that insertion of this conductor is attained according to the section shape of a conductor. That is, this slot depth is set up so that this conductor may not overflow the upper surface of this slot. In the example of FIG. 7, although the slot is formed in one side of a magnetic member, a through-hole maybe formed by forming a slot in both magnetic members, making the slots face to face, and pasting together. In this case, positioning of both magnetic members is made by the conductor inserted.

A magnetic base may comprise two or more members, and the through-hole may be formed after assembling of two or more of said members. The following structures may be used as this embodiment. Namely, a magnetic base comprises sandwiching two laminated magnetic members taking rectangular parallelepiped shape by other magnetic members. Said both other magnetic members take rectangular parallelepiped shape. Said through-hole is formed by setting the interval between said two laminated magnetic members to a predetermined value. The shape of a through-hole and size are determined by this interval and thickness. This structure does not need processing which forms a slot, but a magnetic member is produced only by simple processing. Therefore, it is suitable for simple production of a chip antenna.

It is possible to perform fixation with a magnetic base and a conductor and fixation of magnetic members using a clamp etc. However, adhering is preferred in order to firmly fix these. For example, when adhering a magnetic base and a conductor, adhesives are applied to the gap between a magnetic base and a conductor, and it adheres to it. When adhering in magnetic members, adhesives are applied to a pasting side and it pastes up. As for the thickness of an adhesives layer, since a gap will become large if an adhesives layer becomes thick, 50 micrometers or less are preferred. This thickness may be 10 micrometers or less, more preferably. In order to suppress formation of a magnetic gap, adhesives may be applied to portions other than a pasting side, and it may adhere to them. For example, on the side, adhesives are applied so that the pasting portion of a magnetic member may be straddled. As adhesives, resin, inorganic adhesives, etc., such as thermosetting and ultraviolet curing nature, can be used. Resin may be made to contain magnetic material fillers, such as an oxide magnetic material. It is desirable to use adhesives with high heat resistance as adhesives, in consideration of the case where solder fixation of the chip antenna is carried out. Especially when applying the reflow process at which the whole chip antenna is heated, the heat resistance against 300 degrees C. or more, is preferred. In addition, when the gap between a magnetic base and a conductor is small, and when a motion of the conductor prepared in the through-hole of the magnetic base is fully restrained by a magnetic base, it is not necessary to use a fastener means between a magnetic base and a conductor.

On the other hand, an extrusion-molding method is excellent, in forming the long magnetic base with long through-hole as one. Unlike the case where an above-mentioned magnetic member is pasted together, joint is not formed at all. Therefore, the chip antenna with high strength can be obtained.

As a material of the aforementioned magnetic base, a spinel type ferrite, hexagonal ferrites such as Z type, and Y type and the compound material containing said ferrites materials can be used. As a spine! type ferrite, there are a Ni—Zn ferrite and a Li ferrite. As for this material, it is preferred that they are ceramics of a ferrite, and it is preferred to use the ceramics of Y type ferrite especially. Since the ceramics of a ferrite have high volume resistivity, they are advantageous at the point of aiming at the insulation with a conductor. If ferrite ceramics with high volume resistivity are used, the insulating cover layer is unnecessary between conductors. In Y type ferrite, magnetic permeability is maintained to high frequency of 1 GHz or more. A magnetic loss in the frequency range up to 1 GHz is low. Therefore, it is suitable for the use in the frequency range over 400 MHz, for example, the chip antenna for ground digital broadcasting which uses a 470-770 MHz frequency range. Also, it can be used for digital radio system, in which bandwidth of 189 MHz-197 MHz is used. In this case, it is preferred to use the ceramics of Y type ferrite as a magnetic base. As ceramics of Y type ferrite, not only Y type ferrite single phase but may be mixtures with other phases, for example, Z type, W type. If ceramics have accuracy of dimension sufficient as a magnetic base after sintering, they do not need more processing, but as for a attached surface, it is desirable to give polish processing and to secure flatness.

If initial magnetic permeability at 1 GHz of the above-mentioned Y type ferrite is set to 2 or more, and a loss factor tan $\delta$ is set to 0.1 or less, or is set to 0.05 or less more preferably, it is advantageous when obtaining a chip antenna with wide bandwidth and high gain. If initial magnetic permeability becomes low too much, it will become difficult to make bandwidth wide. Moreover, if a loss factor, i.e., a magnetic loss, becomes large, the gain of a chip antenna will fall. To obtain the average gain of −7 dBi or more, as a chip antenna, loss factor of 0.05 or less, is preferred. A chip antenna with high gain can be obtained by making a loss factor 0.03 or less, especially.

In the structure concerning this invention, a capacity component is hard to form. Therefore, even if relative permittivity becomes large, the increase in the internal loss of an antenna is suppressed. To lower the loss, low relative permittivity is preferred. However, with the structure concerning this invention, the internal loss of an antenna is insensible to relative permittivity. Therefore, in order to suppress the variation in resonance frequency, material with high permittivity can also be used. In this case, setting relative permittivity to 8 or more is preferred, 10 or more, more preferably.

Y type ferrite is explained further. Y type ferrite is a soft ferrite of a hexagonal system typically expressed with the chemical formula of $Ba_2Co_2Fe_{12}O_{22}$ (what is called $Co_2Y$). The above-mentioned Y type ferrite makes M1O (here, Ml is kind of Ba and Sr at least), CoO, and $Fe_2O_3$ the principal component. Moreover, what replaced Ba of the above-mentioned chemical formula by Sr is included. Since Ba and Sr have the comparatively near size of an ionic radius, they constitute Y type ferrite like the case where what replaced Ba by Sr uses Ba. Moreover, similar characteristics are shown and each of these maintains magnetic permeability to a high frequency range.

These mixed ratios just do Y type ferrite with the main phase. For example, setting BaO to 20-23 mol %, CoO to 17-21 mol %, and $Fe_2O_3$ to remainder, is preferred. Furthermore, setting BaO to 20-20.5 mol %, CoO to 20-20.5 mol %, and $Fe_2O_3$ to remainder, is more preferred. Making Y type ferrite into the main phase means that the main peak intensity of Y type ferrite is the maximum among the peaks in X-ray diffraction. Although it is preferred that it is Y type single phase as for this Y type ferrite, other phases, such as other hexagonal ferrites, such as Z type and W type, and $BaFe_2O_4$, may generate. Therefore, in Y type ferrite, it is also permissible that these other phases are included.

As for said Y type ferrite, it is preferred to contain Cu in a very small quantity further. Conventionally, $Cu_2Y$ etc. which used Cu instead of Co as a Y type ferrite are known. The substitution of this Cu mainly aims at the low-temperature sintering aiming at co-firing with Ag, and improvement in magnetic permeability. In this case, there are large amounts of substitution of Cu to Co as tens of % or more, and volume resistivity becomes low, and a loss factor and permittivity also become large. On the other hand, in the case of this invention, the content of Cu is little. Ceramics density can be raised stopping a loss factor low and maintaining volume resistivity highly by making a little Cu contain. Magnetic permeability also improves by making a little Cu contain. The ceramics density more than $4.8\times10^3$ kg/m$^3$ can be obtained by setting content of Cu into 0.1 to L5% of the weight by CuO conversion. Loss factor tan 5 in the frequency of 1 GHz is made to 0.05 or less, and also volume resistivity is made to $1\times10^5$ Ω·m or more, by making content of Cu into the aforementioned range especially. The content of Cu is 0.1 to 0.6% of the weight in oxide conversion more preferably, and can make volume resistivity more than $1\times10^6$ Ω·m in this case. The mechanical strength of the chip antenna used for communication equipment, such as a cellular phone, improves by using the magnetic base which has high density. When it constitutes a chip antenna from this magnetic base, antenna gain falls that volume resistivity is less than $1\times10^5$ Ω·m. Therefore, it is desirable. Especially preferred that it is more than $1\times10^5$ Ω·m, and volume resistivity is more than $1\times10^6$ Ω·m.

When making the ceramics of Y type ferrite into a magnetic base, this Y type ferrite can be produced by the powder metallurgy technique applied to production of the soft ferrite from the former. Minor constituents, such as CuO and ZnO, are mixed with the main raw materials by which weighing capacity was carried out so that it might become desired composition, such as $BaCO_3$, $Co_3O_4$, and $Fe_2O_3$. In addition, minor constituents, such as CuO and ZnO, can also be added in the pulverization process after calcination. A mixed method in particular is not limited. For example, wet blending (for example, for 4 to 20 hours) is carried out through pure water using a ball mill etc. Calcinated powder is obtained by carrying out temporary sintering of the obtained mixed complications at a predetermined temperature using an electric furnace, a rotary kiln, etc. As for the temperature and time of temporary sintering, 900-1300° C. and 1 to 3 hours are desirable respectively. If the temperature and time of temporary sintering are less than these, a reaction will not fully progress. On the contrary, if it exceeds these, pulverization efficiency will fall. As for the atmosphere in temporary sintering, it is desirable that it is under the oxygen existence in the atmosphere or oxygen etc. Wet pulverization of the obtained temporary sintering powder is carried out using attritor, a ball mill, etc., and binders, such as PVA, are added. Then, granulated powder is obtained by granulating with a spray dryer etc. As for the average particle diameter of granulated powder, 0.5-5 micrometers is desirable. The obtained granulated powder is molded with a pressing machine. Then, after sintering in oxygen environment at the temperature of 1200° C. for 1 to 5 hours, using an electric furnace etc., hexagonal ferrite is obtained.

1100-1300° C. of sintering temperature are preferred. Sintering is not fully performed as it is less than 1100° C., and a high ceramics density is not obtained. If it exceeds 1300~C, a exaggerated grain will be generated and it will become over exaggerated. Moreover, if sintering time is short, sintering will not fully be performed. On the contrary, as for this time, since it will be easy to become fault sintering if sintering time is long, 1 to 5 hours is desirable. Moreover, as for sintering, in order to obtain a high ceramics density, it is desirable to carry out under oxygen existence, and it is more desirable to carry out in oxygen. Cutting, polish, slot processing, etc. are processed to the obtained ceramics if needed.

Figure 11:
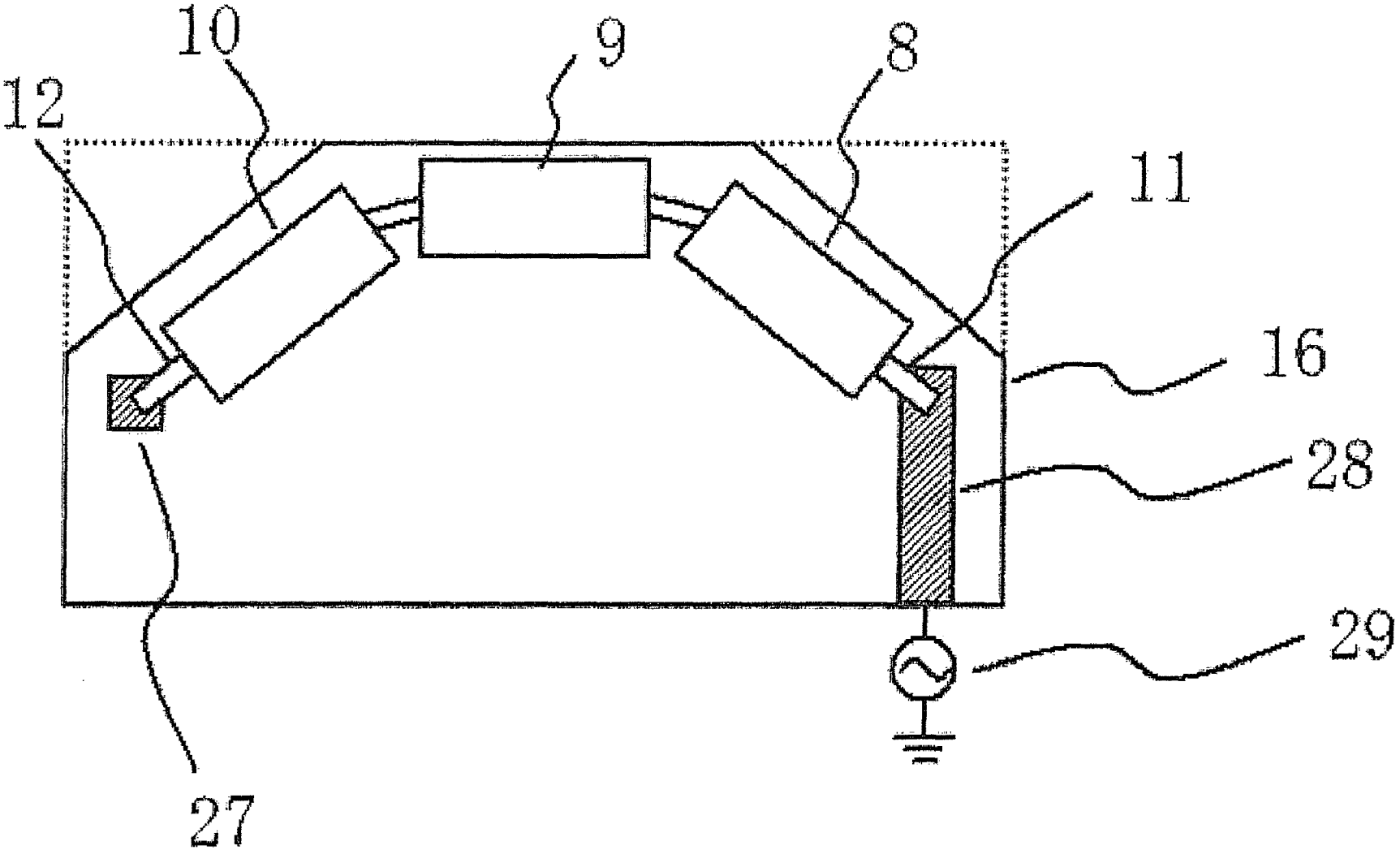
FIG. 11 is a figure showing the example of the antenna device with which the chip antenna concerning this invention was used.

Next, the fixing method of an antenna device is explained using FIG. 11. In the chip antenna of FIG. 4, end 12 of the conductor protruding from magnetic base 10 constitutes an open end. Other end 11 protruding from magnetic base 8 is connected to control circuits (not shown), such as a feeder circuit, and an antenna device is constituted. This end of the conductor which becomes the open end side does not need to be fixed to an electrode etc. However, for stable mounting or adjustment of resonance frequency, it is preferred to also fix the open end side to an electrode etc. An antenna device has the chip antenna shown in FIG. 4, and substrate 16 which mounts said chip antenna. This mounting is performed by connecting ends 11 and 12 of a conductor and the fixing electrode at the bottom of a chip antenna which were formed in the magnetic base, for example by solder etc. The both ends of a conductor are connected by solder to fixing electrode 27 and feed electrode 28, which are the electrode parts bended outside said magnetic base and formed on substrate 16. Feed electrode 28 is connected to the feeder circuit etc. In chip antenna 1, three chip antenna elements are arranged in the shape of an arch. Chip antenna 1 is arranged so that the longitudinal direction of conductors 5, 6, and 7, i.e., the longitudinal direction of magnetic bases 8, 9, and 10, may become parallel to a substrate plane. Therefore, thin and stable mounting is enabled. This feature is the same also in the antenna device of other embodiments mentioned later. In chip antenna 1, the both ends of the conductor are fixed by solder firmly. It may be fixed using adhesives etc. This antenna device can be used as any mode of a receiving antenna, a transmitting antenna, and a transceiver antenna. The antenna may be mounted in a sub-substrate and may be separated from a main circuit. In this case, the distance between the ground part of a main circuit and an antenna spreads. Therefore, a gain and bandwidth become large and, the noise emitted from the main circuit becomes hard to receive for the antenna. Therefore, the receiving sensitivity of radio equipment is improved.

Figure 12:
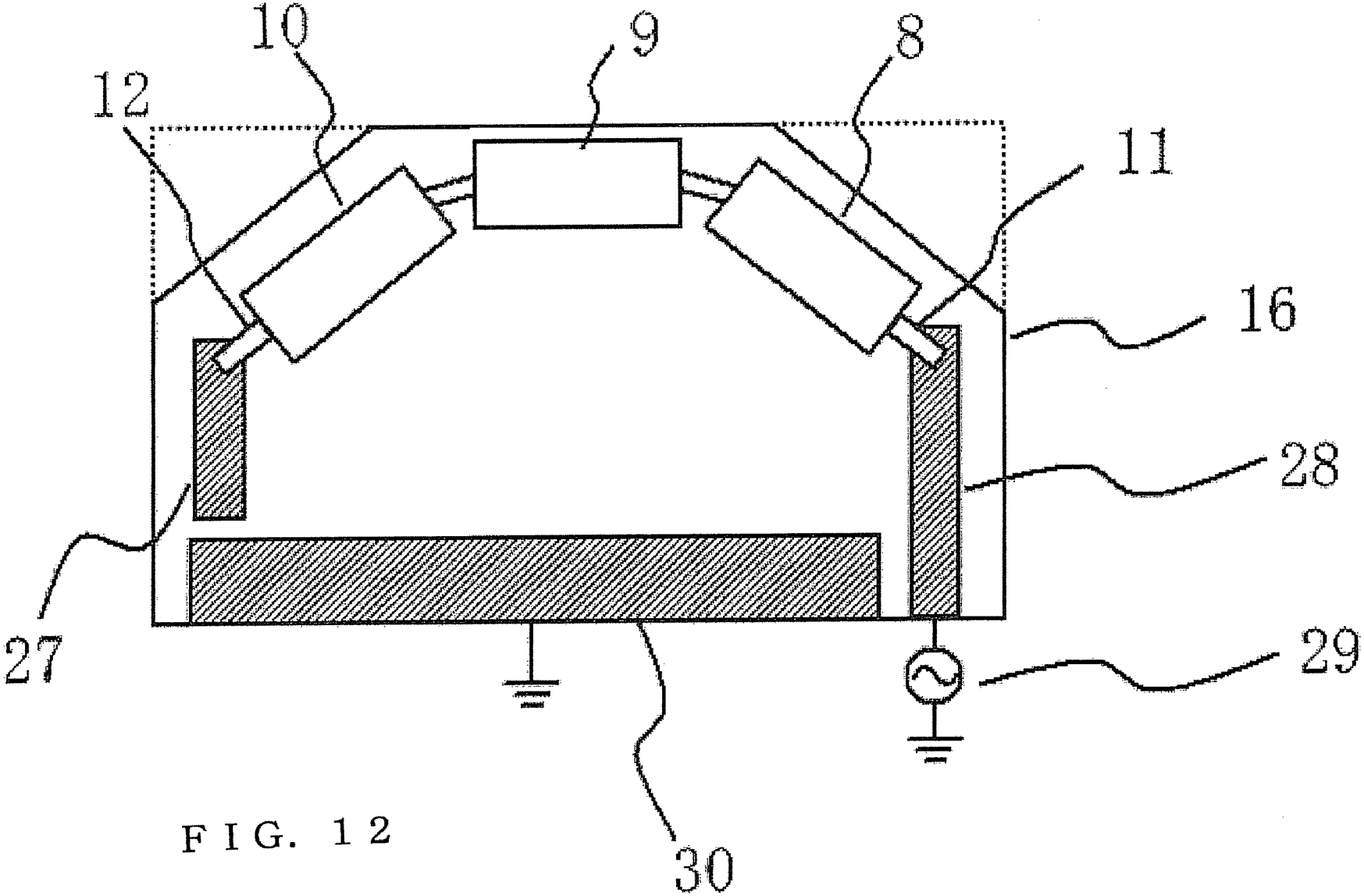
FIG. 12 is a figure showing the example of other antenna devices with which the chip antenna concerning this invention was used.
Figure 13:
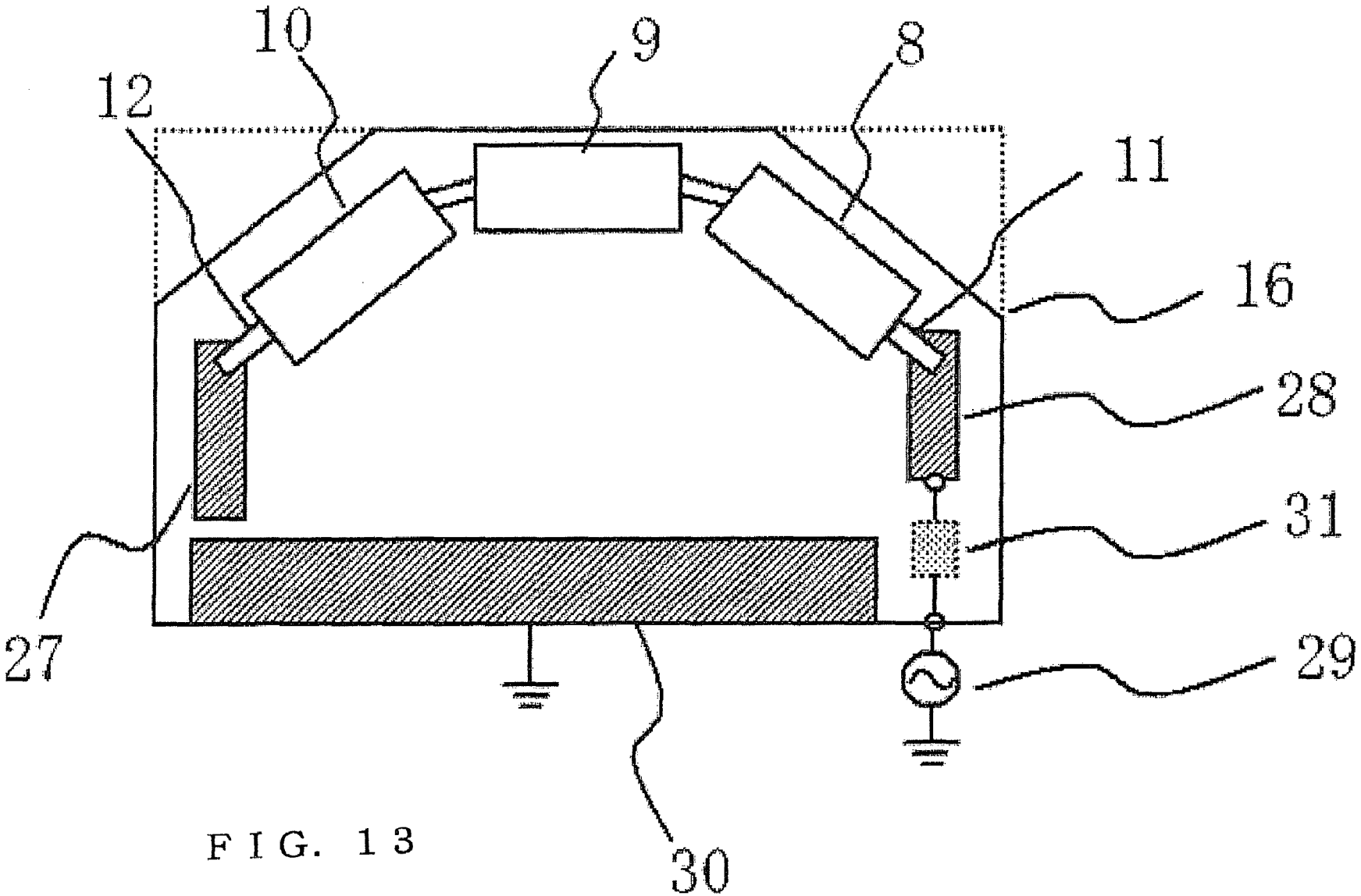
FIG. 13 is a figure showing the example of other antenna devices with which the chip antenna concerning this invention was used.

Next, the adjustment method of an antenna device is explained using FIG. 12. The antenna device shown in FIG. 12 has substrate 16 which mounts the chip antenna shown in FIG. 4, and said chip antenna. Ground electrode 30 is formed and fixing electrode 27 is also formed set apart from the ground electrode 30, on substrate 16. End 12 of the conductor in chip antenna 1 is connected to said fixing electrode 27. Other end 11 of the conductor is connected by solder to feed electrode 28. Feed electrode 28 is connected to the feeder circuit etc. Fixing electrode 27 is formed along a direction perpendicular to the longitudinal direction of magnetic base 9 in a chip antenna element. The end and end of ground electrode 30 are parallel. These ends are separated by the predetermined interval and have faced each other. In the feed electrode 28 are arranged in the shape of character "D". Fixing electrode 27 and ground electrode 30 that serves as the open end side of chip antenna I are formed set embodiment of FIG. 12, chip antenna 1, fixing electrode 27, ground electrode 30, and apart from each other. In this structure, a capacity component is formed among these. In the chip antenna concerning this invention, a helical electrode is not formed in the magnetic base, or said electrode group is arranged in the shape of "D". In this chip antenna, in order that the magnetic base may separate from the ground part of the main circuit, a capacity component is suppressed sharply. However, when capacity is not sufficient for desired antenna characteristics, antenna characteristics can be adjusted by adding a capacity component between fixing electrode 27 and ground electrode 30 thereby. Compared with the method of adjusting the capacity component by adjusting the capacity in chip antenna itself, by the above-mentioned method capacity can be adjusted easily. The example for adjusting the resonance frequency of an antenna is shown in FIG. 13. Between fixing electrode 27 and ground electrode 30, a switch is connected with at least one capacitor, and the capacitor can be switched.

Matching circuit 31 is connected between fixing electrode 28 and feeder circuit 29. Or a variable capacitance diode (varactor diode) is connected and capacity can be changed with this applied voltage. By these, desired resonance frequency can be obtained. According to these methods, compared with the method of adjusting the capacity in the chip antenna itself, capacity can be adjusted simply.

Figure 21:
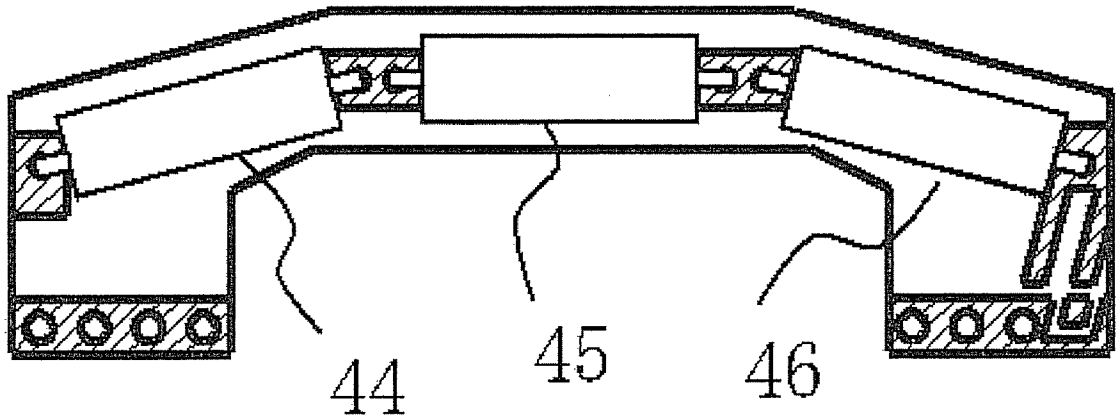
FIG. 21 is a figure showing the example of other antenna devices with which the chip antenna concerning this invention was used.
Figure 21:
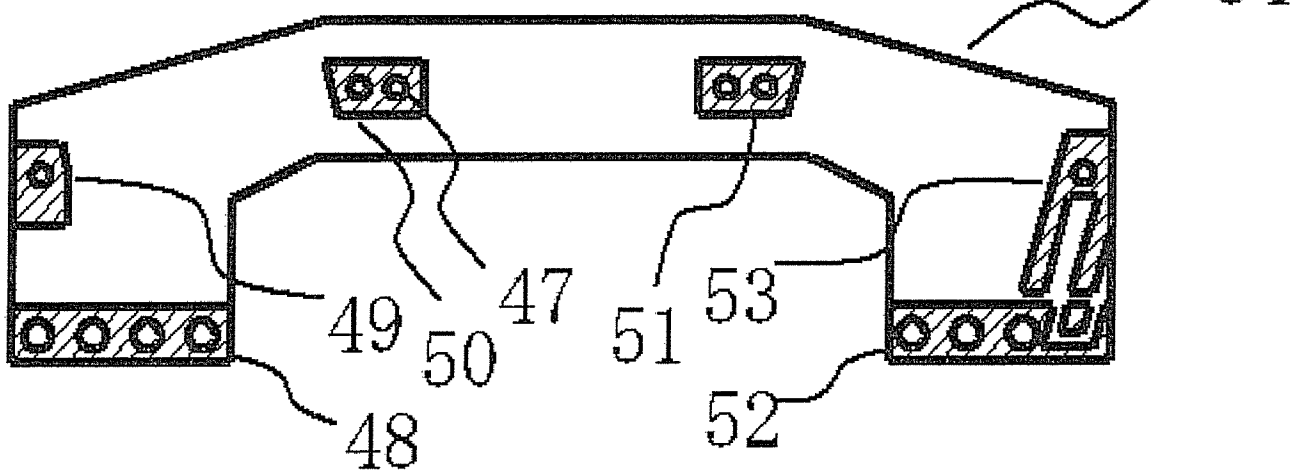

In an antenna device, it is preferred that the shape of the substrate is also produced according to the shape of the chip antenna or communication equipment. Next, another embodiment of an antenna device is described using FIG. 21. The substrate with which the conductor part is formed, and the antenna device with which the chip antenna is mounted on this substrate are shown in (a) in FIG. 21. The substrate used for it is shown in (b). The pattern electrodes made of Cu are formed on substrate 54 taking the shape of character "U", as conductor parts 48-53. Through holes 47 are formed in each conductor part, and the conductor in a chip antenna element etc. can be inserted in it. The pattern electrodes made of Cu are formed also in the reverse side of conductors 48-52 (not shown). Chip antenna elements 44-46 take 9 mm×3 mm×3 mm rectangular parallelepiped shape, respectively, the width of substrate 54 is 40 mm, the width of the gap of the shape of character "U" formed in the center along the width direction is 24 mm, the depth of the gap is 7.5 mm. In the antenna device shown in FIG. 21(*a*) where chip antenna elements 44-46 were mounted, the conductor protruding from the chip antenna element is inserted in through hole 47, and are connected by solder. In said antenna device, conductor parts 50 and 51 formed on the substrate serve as the connection conductor. Conductor parts 48 and 52 are grounded and serve as an ground electrode. Conductor part 49 serves as a fixing electrode to which the open end side of the chip antenna is connected, and is formed set apart from conductor 48, as an ground electrode by 3 mm. A matching circuit is connected to the portion which conductor parts 52 and 53 approach (not shown). The angle formed by adjoining chip antenna elements in the antenna device shown in FIG. 21(*a*) is 165 degrees. If the antenna device shown in FIG. 21(*a*), using substrate 54 taking the shape of character "U", is used, space is made in the center of the antenna device. Therefore, other parts, such as a receiver, can be accommodated in this space. Therefore, communication equipment, such as a cellular phone, can be miniaturized. For example, it is possible for the minimum interval of a chip antenna and a receiver to be 6 mm or less, more specifically about 2 mm.

If an antenna device is constituted using the chip antenna concerning this invention, the frequency range in an antenna device can be made wide. It is also possible to obtain the bandwidth in which average gain is higher than 7 dBi, to be 220 MHz or wider. It is also possible by adjusting resonance frequency to obtain the bandwidth of 300 MHz or wider. For example, the antenna device with the wide bandwidth in a high frequency band of 400 MHz or more, fits the use in the wide frequency range. For example, it is suitable for the digital terrestrial broadcasting in Japan. Like the digital terrestrial broadcasting which uses a 470-770 MHz frequency range, the bandwidth to be used may be wide to the bandwidth of an antenna device. Also in this case, this frequency range can be received using the antenna device of one. If two or more antenna devices are used, a packaging surface and mounting space will increase generally. However, according to the antenna device of this invention, even if bandwidth is wide, the number of antenna devices can be reduced. If three or more antenna devices are used in order to make bandwidth wide, a packaging surface and mounting space will increase vastly. Therefore, when packaging surface is small, such as a portable device, etc. the two or less number of antenna devices is preferred, one more preferably. If the antenna device with the above bandwidth is used, it is also possible to receive a 470-770 MHz frequency range. As an average gain of an antenna device, −7 dBi or higher is preferred, and −5 dBi or more, more preferably.

Figure 14:
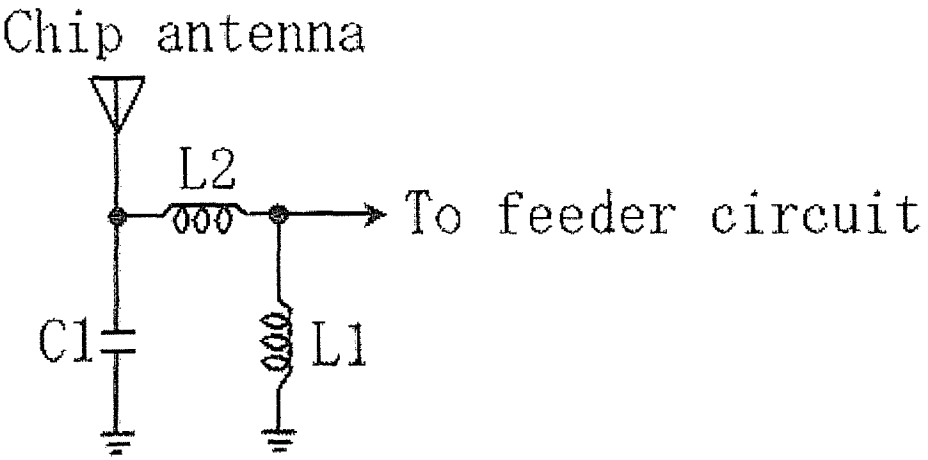
FIG. 14 is a figure showing the example of a matching circuit.
Figure 14:
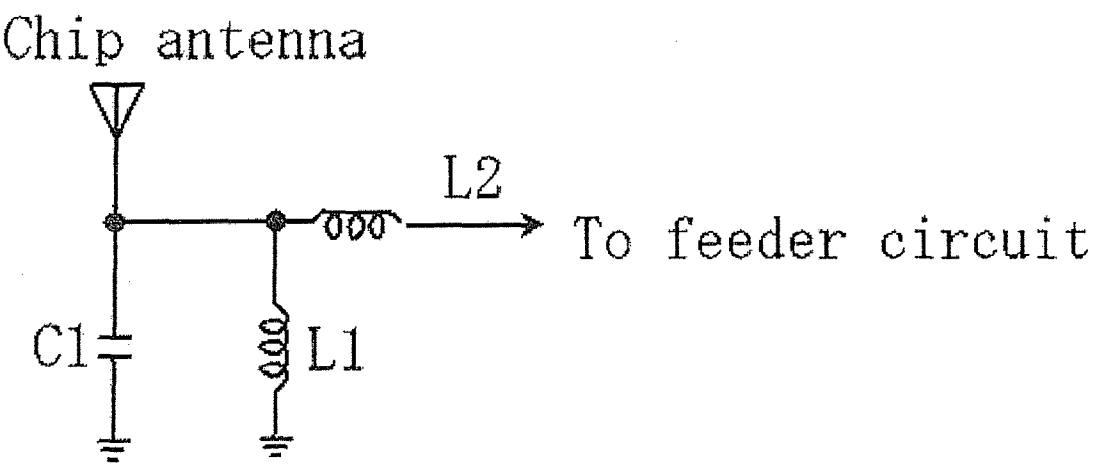

On the other hand, in order to receive the wide frequency range, as shown in FIG. 13 as mentioned above, matching circuit 31 which adjusts the resonance frequency of the antenna device is formed between the chip antenna and the feeder circuit. By switching this matching circuit 31, the resonance frequency of the antenna device may be moved and a frequency range may be changed. The resonance frequency of the antenna device is adjusted by the matching circuit for impedance matching. What is shown in (a) in FIG. 14 and (b) is used for matching circuit 31. Inductor L2 is connected between the other ends of C1 and Li, in which one ends are grounded, and the matching circuit is comprised, as shown in (a) in FIG. 14. The conductor of the chip antenna is connected to the other end of capacitor Cl. A feeder circuit is connected to the other end of inductor L2. Several matching circuits where the inductances in inductor L2 are different, are provided, and these can be switched and changed. One of said two or more matching circuits may be a matching circuit where the inductance is zero, i.e., the inductor L2 is not provided. One end of inductor L2 is connected to the other ends of capacitor C1 and inductor Li, in which one ends are grounded, and the matching circuit is comprised, as shown in (b) in FIG. 14. The conductor of the chip antenna is connected to the other end of capacitor C1 and inductor L1. A feeder circuit is connected to the other end of inductor L2. In order to switch the matching circuit, a switch or a diode with which a semiconductor is used, are used. In this case, it is desirable in respect of the miniaturization of a circuit, integration, or low power.

Figure 22:
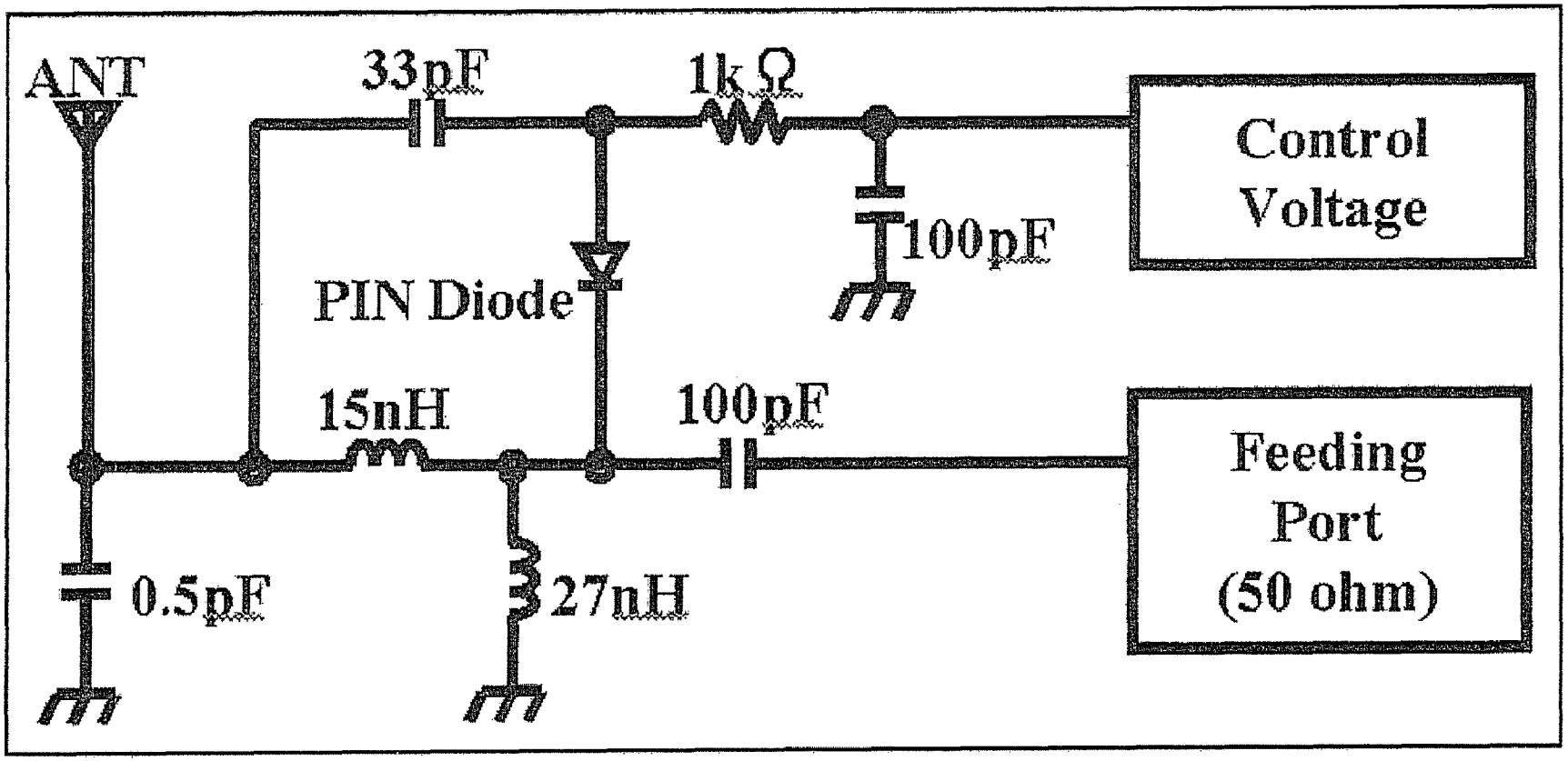
FIG. 22 is a figure showing the example of the circuit for switching the resonance frequency of a matching circuit.

By adjusting control voltage, the matching circuit for high frequency bands and the matching circuit for low frequency band regions are switched. The example of the circuit which switches a matching circuit is shown in FIG. 22. In the example in FIG. 22, when control voltage is 0 V, it changes to the matching circuit for low frequency band regions. When control voltage is +1.8 V, it is switched to the matching circuit for high frequency bands. Only specific circuit elements, such as not only the change of the whole matching circuit but inductor L2, may be switched. If the gain beyond −7 dBi is obtained by switching a matching circuit in an at least 470-770 MHz frequency range, it will become an especially suitable antenna device for the digital terrestrial broadcasting. −5 dBi or higher, is more preferable. If the number of matching circuits and the number of switches increase, so many packaging surface products and the number of parts are needed. In this case, as for the number of matching circuits, since control becomes complicated, it is preferred to use two or less. It is preferred to set the number of switches to 1. To an antenna device with the bandwidth of 220 MHz, in which the complete average of an average gain is higher than −7 dBi, a 470-770 MHz frequency range is receivable using one switch. However, since the chip antenna concerning this invention can receive sufficiently wide bandwidth, it is possible to make it operate without switching.

Figure 15:
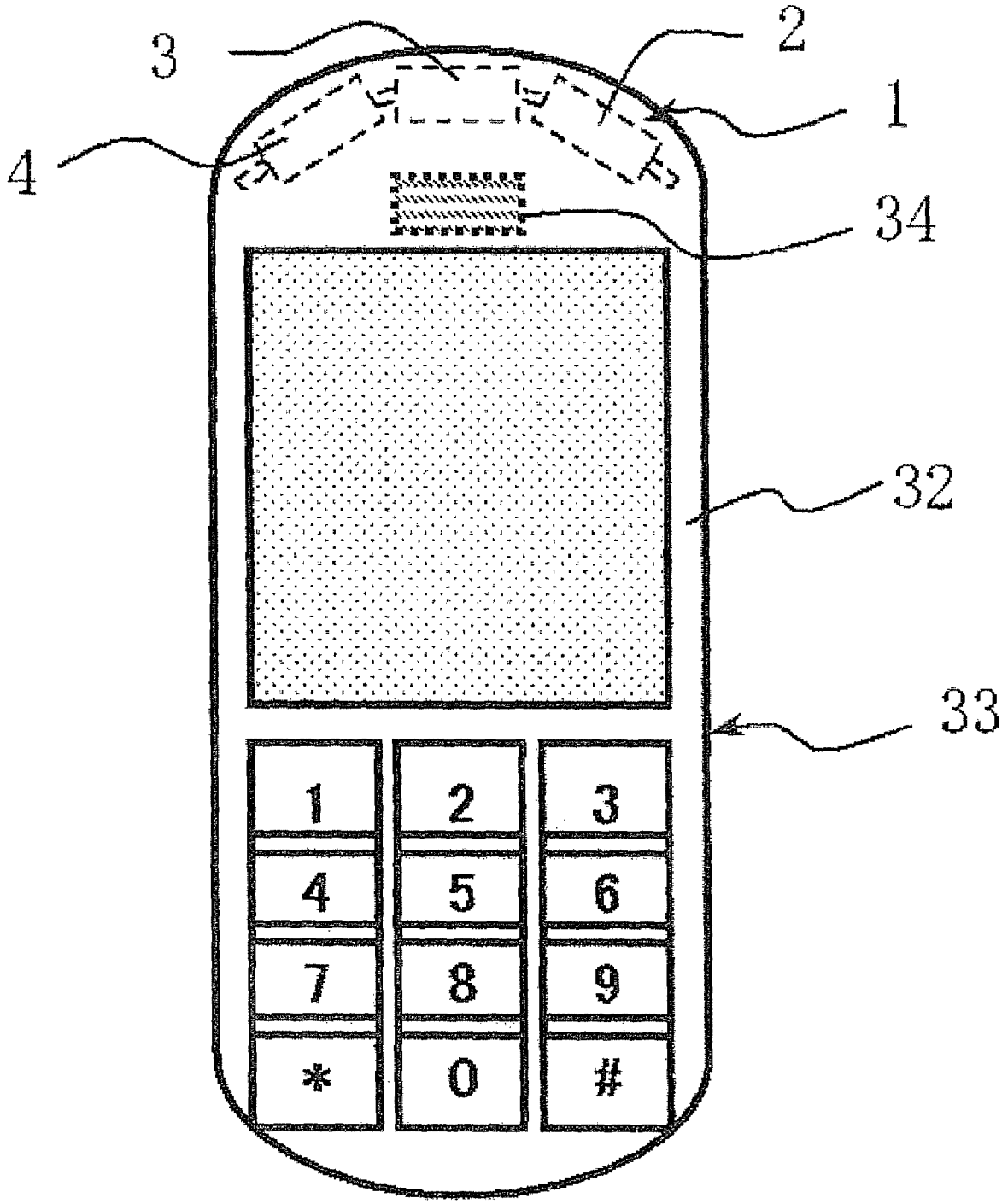
FIG. 15 is a figure showing the cellular phone which is an embodiment of the communication equipment of this invention.

Said antenna device constituted using said chip antenna and it is used for communication equipment. For example, said chip antenna and an antenna device can be used for communication equipment, such as a cellular phone, wireless LAN, a personal computer, and associated equipment of ground digital broadcasting, and are contributed to widen the frequency range in the communication using these apparatus. Since the frequency range of the digital terrestrial broadcasting is wide, the communication equipment using the antenna device concerning this invention is suitable for this use. Since the increase in a packaging surface and mounting space can be suppressed by using the antenna device of this invention especially, it is suitable for a cellular phone, a personal digital assistant, etc. which transmit and receive ground digital broadcasting. The example used for the cellular phone is shown in FIG. 15 as communication equipment. The position of built-in chip antenna 1 is shown by the dotted line. In cellular phone 33, chip antenna 1 is attached to a substrate and connected to the wireless module. The 1st chip antenna element 4 and two 2nd chip antenna element 2 and 3, that constitutes chip antenna 1, are arranged taking curved shape. Chip antenna 1 is arranged along the inner side, at the tip of the case of cellular phone 33. In order to mount by lessening the space loss in the end part of the cellular phone, as for the angle of chip antenna elements, 90 to 170 degrees is preferred, and its 110 to 165 degrees are still more preferred. Electromagnetic waves are mainly emitted to the perpendicular direction of current from an antenna. However, if an angle is set up as mentioned above, direction of the current of each chip antenna element differs. Therefore, each directivity differs and a local gain fall becomes small.

Figure 18:
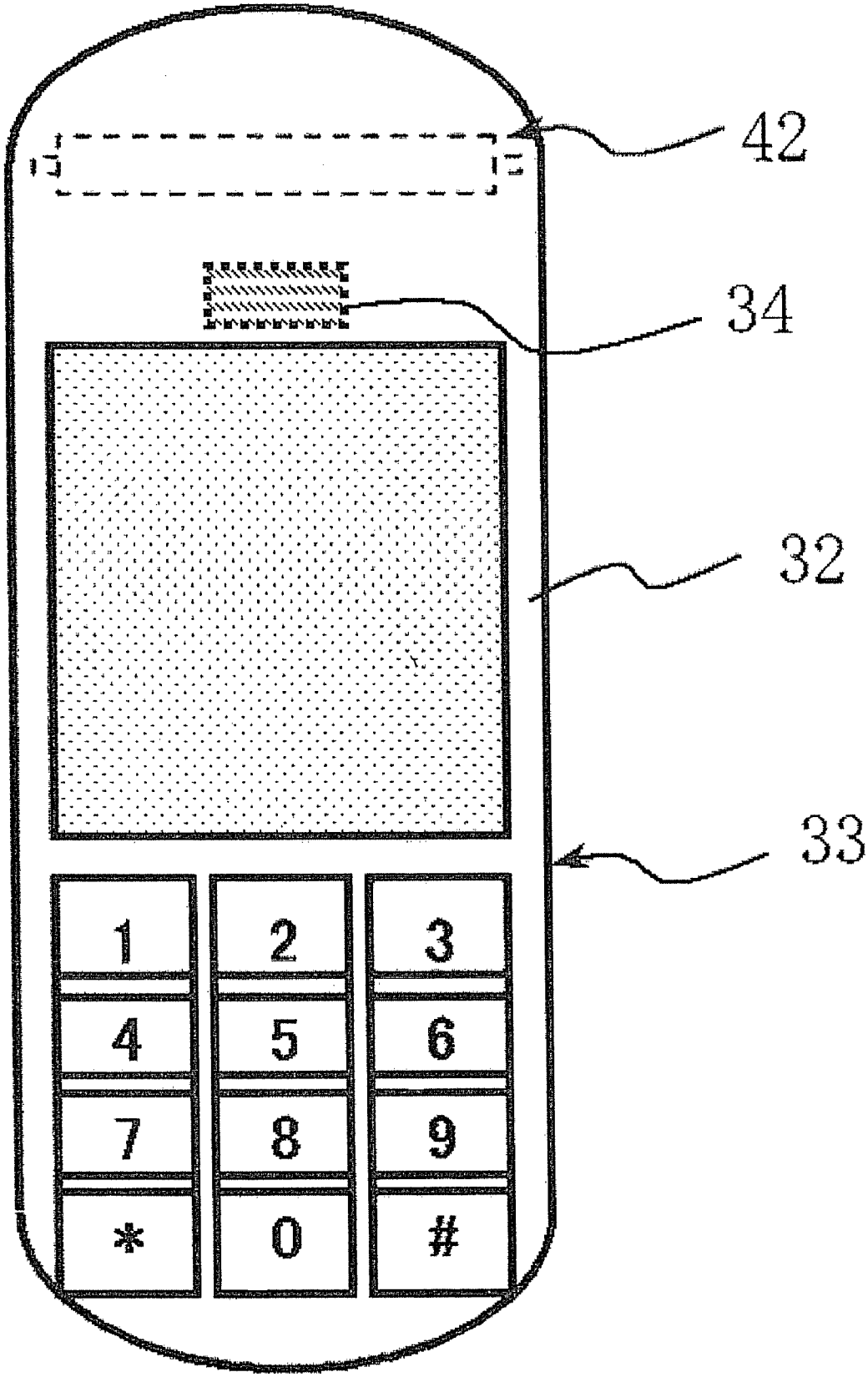
FIG. 18 is a figure showing the cellular phone which is the communication equipment of a comparative example.

Here, the example in which chip antenna 42 having same length as the sum of the length of the magnetic bases of said chip antenna element, was mounted at the tip of cellular phone 33 is shown in FIG. 18. Cellular phone 33 has the wide width of a case, and useless space exists at a tip. Therefore, in communication equipment concerning this invention, a magnetic base can be divided suitably. Therefore, a loss in mounting space is lessened and a chip antenna can be mounted efficiently. Therefore, communication equipment concerning this invention is also suitable for miniaturization. A part of the electromagnetic wave emitted from the antenna become hard to flow into a metal part, setting interval of the antenna and surrounding metal parts (a loudspeaker, receiver 34, liquid crystal display element 32, etc.) large. Therefore, a gain and sensitivity of the antenna improve and electromagnetic radiation from the metal part is controlled. Therefore, directive disorder is reduced. A chip antenna concerning this invention has two or more chip antenna elements, can connect this chip antenna element taking curved shape, and can arrange a chip antenna element side by side along the longitudinal direction. Therefore, a chip antenna in which the sum of the length along longitudinal direction of the magnetic base in said two or more chip antenna elements is wider than the width of the communication equipment, can be mounted. In the case of a cellular phone shown in FIG. 15, the whole terminal can be miniaturized by forming receiver 34 between the antenna device and liquid crystal display element 32.

As shown in (a) in FIG. 6, and (b), at least one of a connection conductor between chip antenna elements, or the protruding conductor, is connected by solder etc., to the conductor part of the substrate of communication equipment. Therefore, a chip antenna can be fixed firmly. Preferably, a connection conductor between chip antenna elements and a protruding part in both ends, are connected by solder etc., to the conductor part on the substrate of communication equipment. Adhesives may be used for fixation of the chip antenna. An electrode can be formed in the magnetic base by the printing method etc., this electrode and a conductor part of the substrate can be connected by solder etc., and it can also be made firmer fixation. Arrangement in chip antenna 1 is not restricted to a form of FIG. 15. Chip antenna 1 may be arranged at the reverse end side of cellular phone 33. In this case, antenna a is hard to receive a part of noise emitted from liquid crystal display element 32 by keeping away antenna a and liquid crystal display element 32. Therefore, receiving sensitivity is improved.

Figure 16:
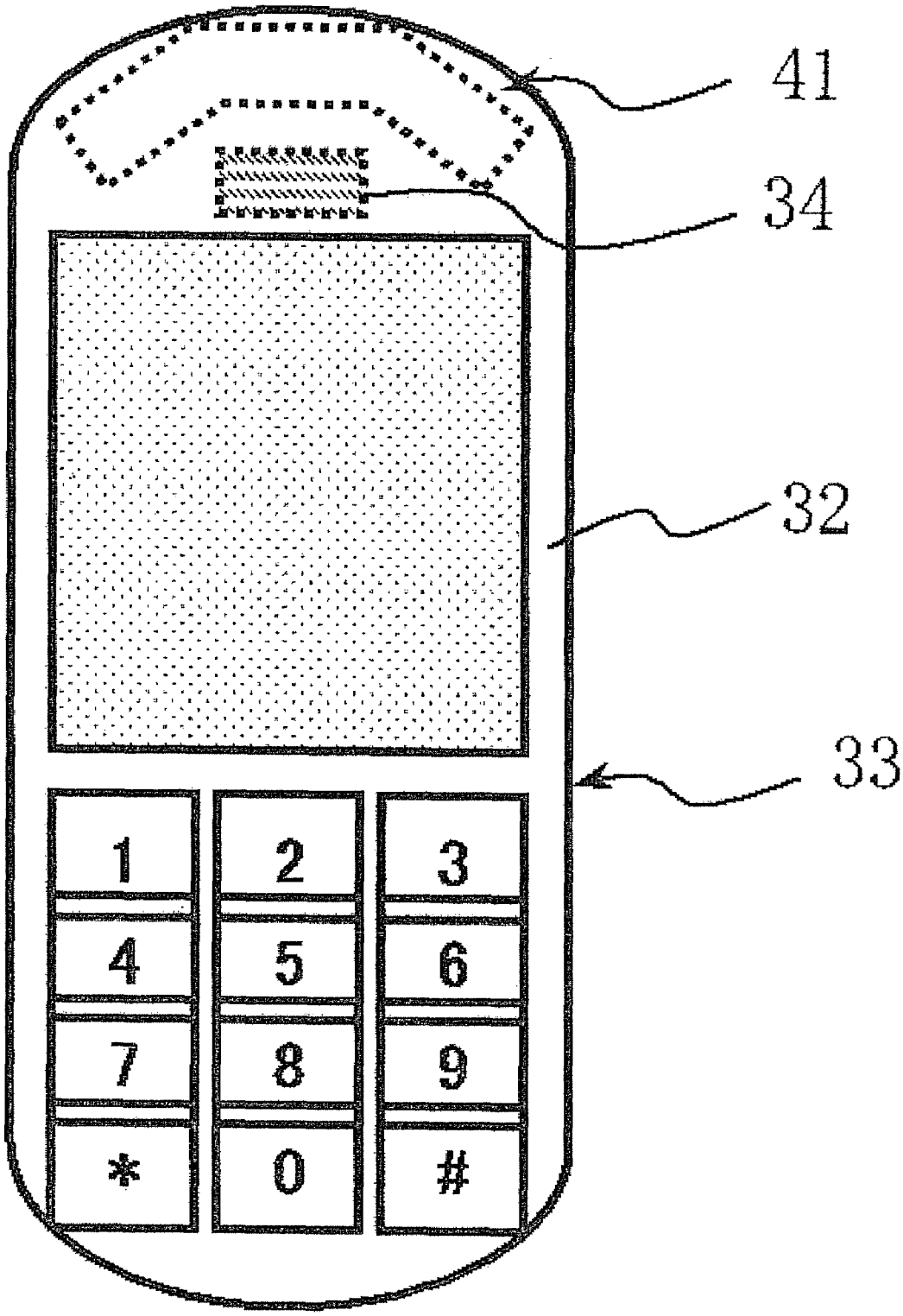
FIG. 16 is a figure showing the cellular phone which are other embodiments of the communication equipment of this invention.

Next, an embodiment in which a chip antenna accommodated in one case where a conductor member was formed on a lateral surface, is mounted in a cellular phone, is shown in FIG. 16. In an example in FIG. 16, a conductor member formed on said case and the conductor part of the substrate of the cellular phone are connected by solder. Shape of the case fits the shape of a tip of the cellular phone. Therefore, a loss of mounting space can be lessened by this structure, and communication equipment in which a chip antenna was mounted firmly, is obtained.

Figure 17:
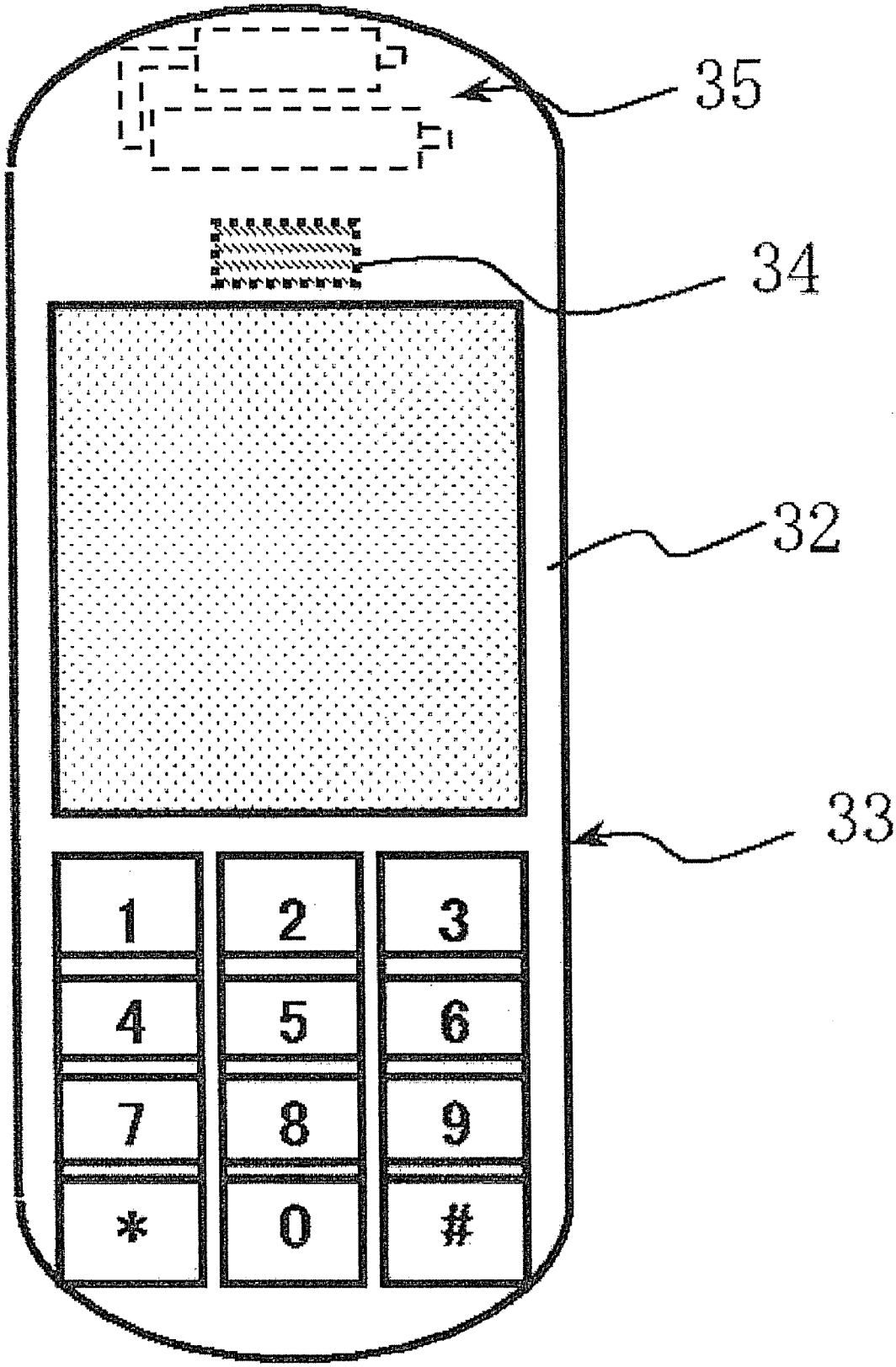
FIG. 17 is a figure showing the cellular phone which are other embodiments of the communication equipment of this invention.

Other embodiments of communication equipment concerning this invention are shown in FIG. 17. In a cellular phone shown in FIG. 17, the 1st chip antenna element and 2nd chip antenna element that constitute chip antenna 35, are arranged taking meander shape. The 2nd chip antenna element having a short magnetic base is arranged at the tip side of the cellular phone. The 1st chip antenna element that has a longer magnetic base than that, is arranged along with that. A line conductor of one is turned up among these chip antenna elements, and serves as meander shaped arrangement. Also in this case, the shape of the chip antenna can be fit in the shape of a tip of the cellular phone. Furthermore, chip antenna elements may be arranged under the 2nd chip antenna element, and the line conductor of one may be turned up. In this case, an antenna for multi bands having two or more modes of resonance with parasitic capacitance produced to each part of an antenna, is obtained.

Technical contents, as mentioned above, such as arrangement of an explained chip antenna, can be applied to the antenna devices in which what is called sub-substrate is used, not only to communication equipments.

Hereafter, this invention is not limited by these examples although an example explains this invention still more concretely.

EXAMPLE

In production of the magnetic base in this example, $Fe_2O_3$, BaO ($BaCO_3$ is used), and CoO ($Co_3O_4$ is used), these are the principal component, were first mixed with 60 mol %, 20 mol %, and 20 mol, respectively. CuO of the composition shown in Table 1 to this principal component 100 weight part was added, and it was mixed with the wet ball mill by using water for 16 hours (No 1-7).

Next, temporary sintering was carried out at 1000~C in atmosphere in 2 hours after drying such mixed powder. Such temporary sintering powder was ground by the wet ball mill by using water for 18 hours. Binder (PVA) 1% was added to the obtained pulverized powder, and granulated. After granulation, compression molding was carried out to ring shape and rectangular parallelepiped shape. Then, sintering was carried out at 1200° C. in oxygen environment for 3 hours. The density, initial magnetic permeability μ at 25° C., and loss factor tan δ, in the ring shape ceramics with the outer diameter of 7.0 mm, a bore of 3.5 mm, and a height of 3.0 mm obtained by these, were measured.

The measured volume resistivity, density, and initial magnetic permeability μ and loss factor tan δ in the frequency of 1 GHz, are shown in Table 1. In addition, the density was measured by the underwater substitution method. Initial magnetic permeability μ and loss factor tan δ were measured using the impedance gain phase analyzer (HP4291B made by Yokogawa-Hewlett-Packard). About some samples, permittivity was also measured using this impedance gain phase analyzer. Here, permittivity means relative permittivity.

TABLE 1

| No. | CuO (wt. %) | volume resistivity $\times 10^5$ ($\Omega \cdot m$) | density $\times 10^3$ ($kg/m^3$) | initial permeability μ (1 GHz) | loss factor tan δ (1 GHz) |
|---|---|---|---|---|---|
| 1 | 0 | 35.6 | 4.52 | 2.1 | 0.01 |
| 2 | 0.2 | 31.9 | 5.12 | 2.1 | 0.02 |
| 3 | 0.4 | 23.3 | 4.82 | 2.2 | 0.02 |
| 4 | 0.6 | 25.9 | 4.84 | 2.8 | 0.01 |
| 5 | 1.0 | 2.3 | 4.91 | 2.7 | 0.03 |
| 6 | 1.5 | 1.1 | 4.92 | 3.1 | 0.04 |
| 7 | 2.0 | 0.7 | 5.05 | 3.4 | 0.06 |

As a result of the X-ray diffraction, in the material of No 1-7, the phase with the largest main peak intensity was Y type ferrite, and Y type ferrite became a main phase. It is shown in Table 1, the initial magnetic permeability of 2 or more, and loss factor of 0.05 or less at 1 GHz, were obtained in the Y type ferrite with addition of CuO 0.1-1.5 wt %. Volume resistivity higher than $1\times10^5$ Ω·m, density higher than $4.8\times10^3$ $kg/m^3$, are obtained, these are sufficient. Among these, when CuO is added especially 0.6 to 1.0%, high initial magnetic permeability of 2.7 or higher, low loss factor of 0.03 or lower, and high density of $4.84\times10^3$ $kg/m^3$ or higher, are obtained. Then, the material based on the sample of No 4 with high density, high initial magnetic permeability, and low loss factor, was selected for a magnetic base. The relative permittivity of the sample of No. 4 was 14.

The chip antenna shown in FIG. 7 using the ceramics of the material of above-mentioned No. 4 was produced as follows. The magnetic members of the rectangular parallelepiped (30×3×1.25 mm and 30×3×1.75 mm) were obtained by machining ceramics, respectively. In the magnetic member which is 30×3×1.75 mm, a slot 0.5 mm in width and 0.5 mm in depth was formed along with the longitudinal direction, in the center of the cross direction of the surface which is 30×3 mm. After copper wire with the section of 0.5 mm squares and a length of 40 mm was inserted in this slot as a conductor, a 30×3×1.25 mm magnetic member pasted up with epoxy adhesive (Aremco bond 570). Adhesives were applied to the pasting side of a magnetic member. The through-hole whose sections are 0.5 mm×0.5 mm was formed by the slot formed in the aforementioned magnetic member. The size of the base obtained by adhesion is 30×3×3 mm. In this way, the chip antenna in which copper wire has protruded from the end face of the magnetic base, was obtained (antenna a).

Two pairs of the magnetic members of the rectangular parallelepiped (15×3×1.25 mm and 15×3×1.75 mm) were obtained by machining ceramics, made of the material of above-mentioned No. 4, respectively. In the magnetic member which is 15×3×1.75 mm, a slot 0.5 mm in width and 0.5 mm in depth was formed along the longitudinal direction, in the center of the cross direction of the surface which is 15×3 mm. After copper wire with the section of 0.5 mm squares was inserted in this slot as a conductor, a 15×3×1.25 mm magnetic member pasted up with epoxy adhesive. The method of adhesion is the same as that of the case of chip antenna 1. The length of the conductor between chip antenna elements is 7 mm. In this way, a chip antenna (antenna b) shown in FIG. 2, having two chip antenna elements which have 15×3×3 mm magnetic base, was fabricated. In this case, the ratio of the width w to the length of the magnetic base d, w/d, is set to ⅕.

Three pairs of the magnetic members of the rectangular parallelepiped (9×3×1.25 mm and 9×3×1.75 mm) were obtained by machining ceramics, made of the material of above-mentioned No. 4, respectively. In the magnetic member which is 9×3×1.75 mm, a slot 0.5 mm in width and 0.5 mm in depth was formed along the longitudinal direction, in the center of the cross direction of the surface which is 9×3 mm. After copper wire with the section of 0.5 mm squares was inserted in this slot as a conductor, a 9×3×1.25 mm magnetic member pasted up with epoxy adhesive. The method of adhesion is the same as that of the case of chip antenna 1. The length of the conductor between chip antenna elements was 4 mm. In this way, a chip antenna (antenna b) shown in FIG. 4, having three chip antenna elements which have 9×3×3 mm magnetic base, was fabricated. In this case, the ratio of the width w to the length of the magnetic base d, w/d, is set to ⅓.

A magnetic material chip antenna was fabricated as follows for comparison. The member of a 30×3×3 mm rectangular parallelepiped was obtained from the material of said No. 4 by machining. The electrode of the helical structure with 12 turns and with the width at 0.8 mm, was formed on the surface, by printing and baking of Ag—Pt paste, thereby, the chip antenna was produced (antenna d).

Said antennas a-d are mounted on the substrate on which the feed electrode was formed, respectively, the end of the electrode is connected to the feed electrode, and the antenna device mounted in a cellular phone, is constituted (it is called as antenna systems A-D, respectively). A chip antenna element and a circuit board adhere with an epoxy adhesive, and their shock resistance is improved. The structure of antenna device A shall be shown in FIG. 19. Namely, the feed electrode, the ground electrode, and the fixing electrode that was set apart from the ground electrode, were formed on the printed circuit board. The conductor of the both ends of antenna a was bended in the position set apart from the end face of the magnetic base, these both ends were connected by solder to the feed electrode and the fixing electrode, respectively. The width of the fixing electrode was 4 mm and length was 13 mm. The gap between the end in the longitudinal direction of this fixing electrode and ground electrode, is 1 mm. The ground electrode was formed so that the whole longitudinal direction of a chip antenna might be countered, and the interval to the magnetic base in the chip antenna was 11 mm. The matching circuit shown in FIG. 14(*b*) was used.

Figure 19:
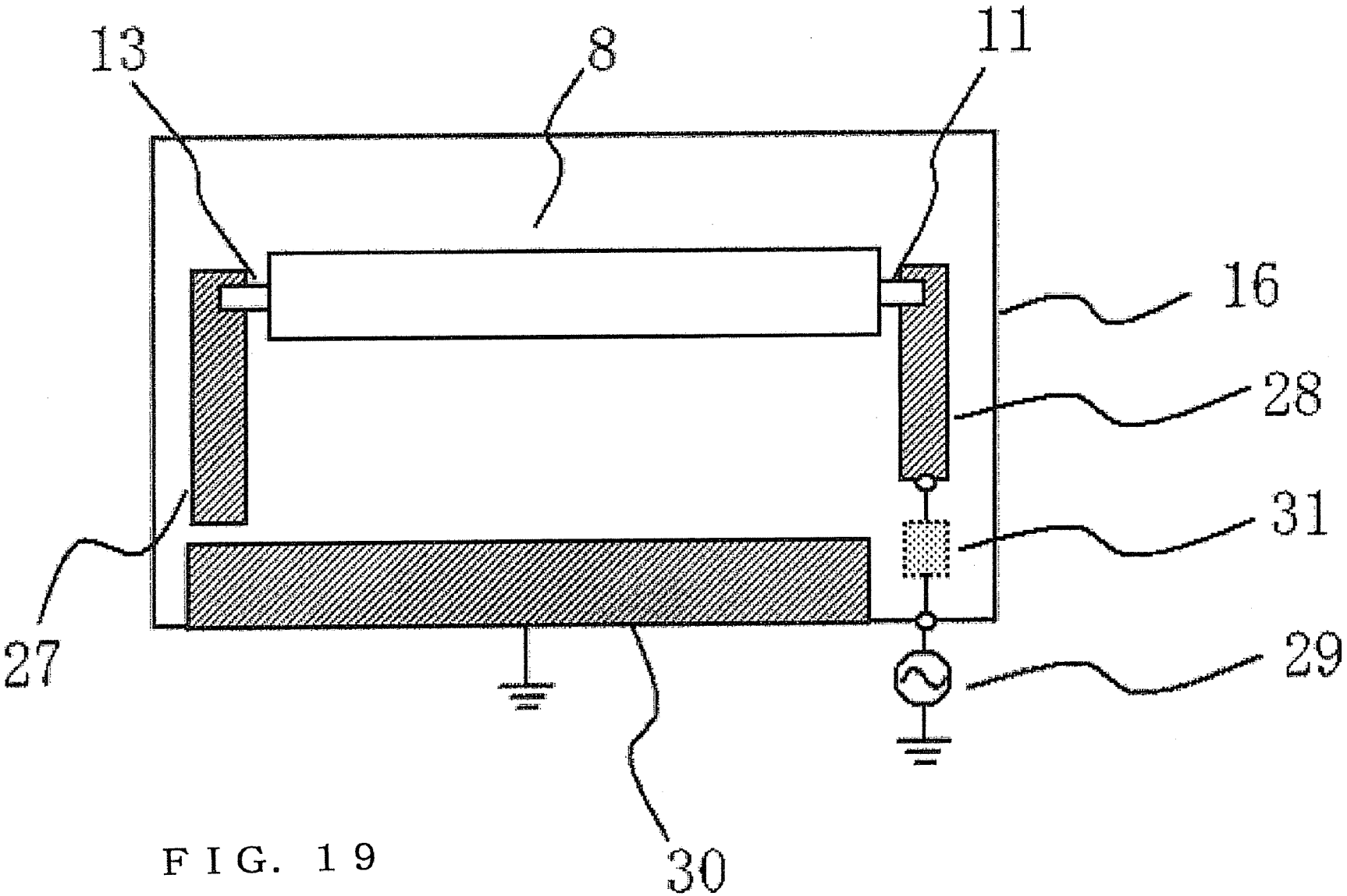
FIG. 19 is a figure showing the antenna device which used the chip antenna for comparison.

C1 was set to 0.5 pF, L1 was set to 56 nH, and L2 was set to 15 nH. The above-mentioned antenna device was separated from the antenna for measurement (it installs in the right-hand side of the antenna device of FIG. 19 (not shown)) by 3 m, and was connected to the antenna gain evaluation system using a network analyzer via a 50-ohm coaxial cable. Thereby, antenna characteristics were evaluated. The longitudinal direction in the chip antenna in FIG. 19, is set to X, the direction perpendicular to X, is set to Y. The direction perpendicular to both X and Y, namely the direction perpendicular to the substrate surface, is set to Z. The average over the 3 planes, such as XY-plane, YZ-plane, and ZX-plane, of an average gain, is shown in FIG. 20.

The structure of antenna device C is shown in FIG. 13. Namely, the feed electrode, the ground electrode, and the fixing electrode that is set apart from the ground electrode, were formed on the printed circuit board. When the antenna device is mounted in a cellular phone, the printed circuit board (for example, dropped by the dotted line portion) taking the shape fitting the shape of the cellular phone, is used. The conductor of the both ends in antenna c is bended in the position set apart from the end face of the magnetic base. These both ends were connected by solder to the feed electrode and the fixing electrode, respectively. The width of the fixing electrode is 4 mm and length is 6 mm. The gap between the end in the longitudinal direction of this fixing electrode and ground electrode, is 1 mm. The 2nd magnetic base of the 2nd chip antenna element (central chip antenna element), adjoining the magnetic base of the 1st chip antenna element, faces the ground electrode in parallel, the interval between them is set to 12 mm. Both the angle formed by the magnetic base of the 1st chip antenna element and the magnetic base of the 2nd chip antenna element adjoining that, and the angle formed by the magnetic bases of the 2nd chip antenna element, were made into 135 degrees. The matching circuit shown in FIG. 14(*b*) was used. C1 was set to 0.5 pF, L1 was set to 56 nH, and L2 was set to 22 nH. The measured antenna characteristics as the case of antenna device A, are shown in FIG. 20.

Antenna device B was formed as said antenna device C, except changing the chip antenna shown in FIG. 13 to antenna b. The magnetic base of the 1st chip antenna element and the end face (end by the side of a connection conductor) of the magnetic base of the 2nd chip antenna element, facing the ground electrode, were set apart from the ground electrode by 14 mm. The angle formed by the magnetic base of the 1st chip antenna element and the magnetic base of the 2nd chip antenna element, was made into 110 degrees. The same matching circuit as antenna device C was used. The measured antenna characteristics as antenna device A, are shown in FIG. 20. Antenna device D was fabricated using antenna d. The feed electrode and the ground electrode were formed on the printed circuit board. The end of the conductor in antenna d was connected to the feed electrode of the magnetic base by solder. The ground electrode was formed along the whole longitudinal direction of antenna d, facing the antenna d, and the interval between the base and the ground electrode is set to 11 mm. The matching circuit is not used. The measured antenna characteristics as antenna device A, are shown in FIG. 20.

Figure 20:
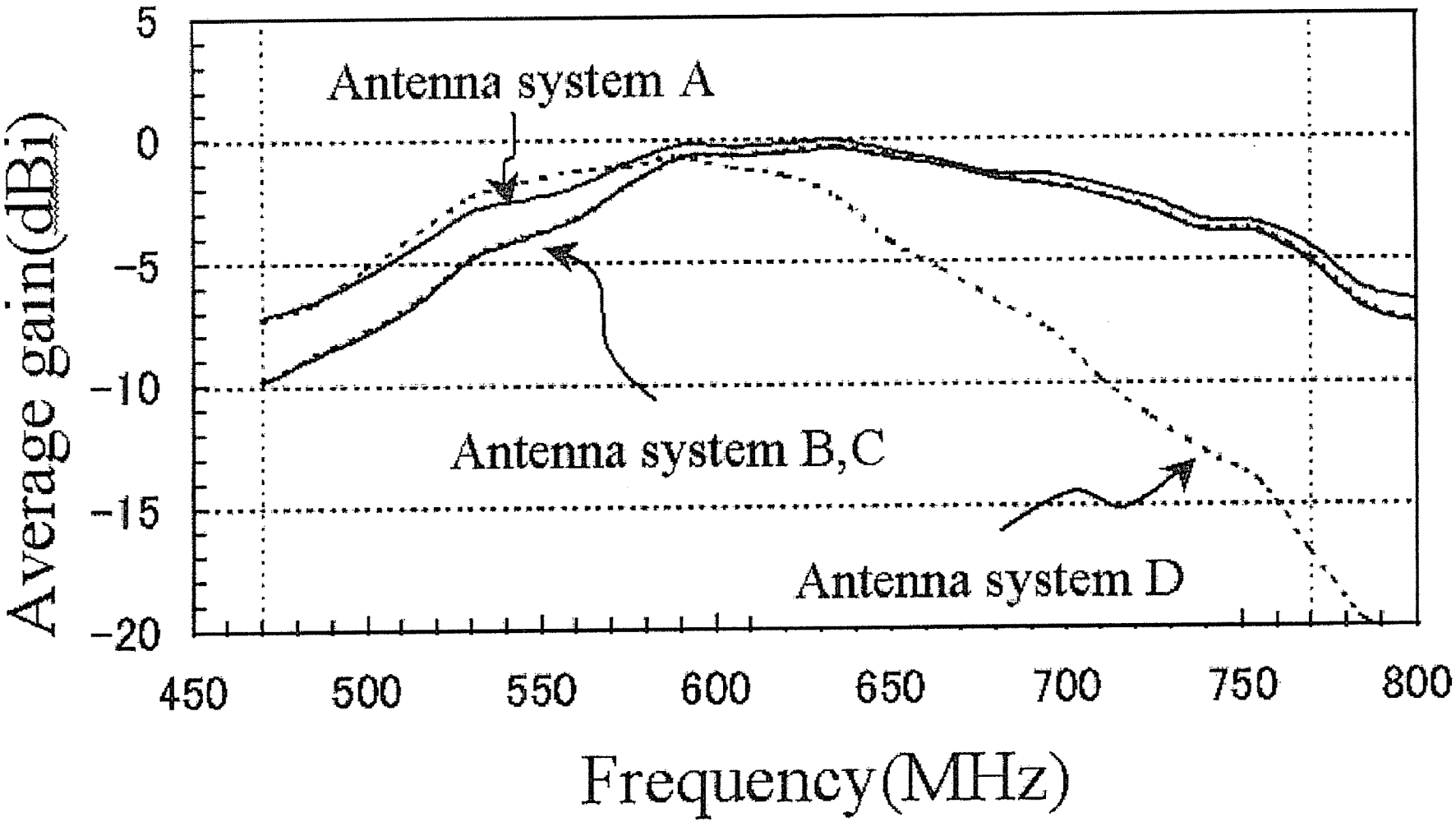
FIG. 20 is a figure showing the frequency dependence of an average gain.

As shown in FIG. 20, compared with antenna d using the chip antenna with which the herical electrode was formed, antenna a-c has higher average gain, also bandwidth is wider and outstanding antenna characteristics are shown. The magnetic base is divided in antennas b and c provided with two or more chip antenna elements. However, compared with antenna d which comprises one chip antenna element, a practically significant difference is not found in antenna characteristics. It turns out that it hardly depends for antenna characteristics on the number of chip antenna elements. In FIG. 20, the curve corresponding to antenna b and the curve corresponding to antenna c have overlapped. The average gain of antennas b and c is higher than −10 dB in a 470 to 770 MHz band. The bandwidth with an average gain of 7 dB or higher, is 260 MHz or wider. Bandwidth with an average gain of −5 dB or higher, is also 240 MHz or wider, and is very wide. Namely, outstanding antenna characteristics are obtained using the chip antenna concerning this invention. And since the flexibility in the shape of a chip antenna becomes higher, as for the communication equipment using this, the mounting efficiency of space becomes higher.

What is claimed is:

1. A chip antenna, comprising:

a 1st chip antenna element having a 1st magnetic base and a linear conductor formed in the core of said 1st magnetic base, so that one end of said linear conductor has protruded from one end face of said 1st magnetic base at least, a 2nd chip antenna element having a 2nd magnetic base and a linear conductor penetrating said 2nd magnetic base, said conductor of said 1st chip antenna element and said conductor of said 2nd chip antenna element being connected by a connection conductor formed between said 1st chip antenna element and said 2nd chip antenna element in series.

2. The chip antenna according to claim 1, wherein said conductor of said 1st chip antenna element penetrates said 1st magnetic base.

3. The chip antenna according to claim 1, wherein two or more said 2nd chip antenna elements are used, wherein said conductors of said 2nd chip antenna elements are connected mutually in series by connection conductors formed between said two or more 2nd chip antenna elements.

4. The chip antenna according to claim 2, wherein two or more said 2nd chip antenna elements are used, wherein said conductors of said 2nd chip antenna elements are connected mutually in series by connection conductors formed between said two or more 2nd chip antenna elements.

5. The chip antenna according to claim 1, wherein both ends of said conductor of said 2nd chip antenna element are protruding from said 2nd magnetic base, wherein one end at least of said conductor of said 1st chip antenna element is protruding from said 1st magnetic base.

6. The chip antenna according to claim 2, wherein both ends of said conductor of said 2nd chip antenna element are protruding from said 2nd magnetic base, wherein one end at least of said conductor of said 1st chip antenna element is protruding from said 1st magnetic base.

7. The chip antenna according to claim 3, wherein both ends of said conductor of said 2nd chip antenna element are protruding from said 2nd magnetic base, wherein one end at least of said conductor of said 1st chip antenna element is protruding from said 1st magnetic base.

8. The chip antenna according to claim 4, wherein both ends of said conductor of said 2nd chip antenna element are protruding from said 2nd magnetic base, wherein one end at least of said conductor of said 1st chip antenna element is protruding from said 1st magnetic base.

9. The chip antenna according to claim 5, wherein said conductor of said 1st chip antenna element, said conductor of said 2nd chip antenna element, and said connection conductor, are united and formed as one linear conductor.

10. The chip antenna according to claim 6, wherein said conductor of said 1st chip antenna element, said conductor of said 2nd chip antenna element, and said connection conductor, are united and formed as one linear conductor.

11. The chip antenna according to claim 7, wherein said conductor of said 1st chip antenna element, said conductor of said 2nd chip antenna element, and said connection conductor, are united and formed as one linear conductor.

12. The chip antenna according to claim 8, wherein said conductor of said 1st chip antenna element, said conductor of said 2nd chip antenna element, and said connection conductor, are united and formed as one linear conductor.

13. The chip antenna according to claim 1, wherein said 1st chip antenna element and said 2nd chip antenna element are accommodated in one case.

14. The chip antenna according to claim 2, wherein said 1st chip antenna element and said 2nd chip antenna element are accommodated in one case.

15. The chip antenna according to claim 3, wherein said 1st chip antenna element and said 2nd chip antenna element are accommodated in one case.

16. The chip antenna according to claim 4, wherein said 1st chip antenna element and said 2nd chip antenna element are accommodated in one case.

17. The chip antenna according to claim 5, wherein said 1st chip antenna element and said 2nd chip antenna element are accommodated in one case.

18. The chip antenna according to claim 6, wherein said 1st chip antenna element and said 2nd chip antenna element are accommodated in one case.

19. The chip antenna according to claim 7, wherein said 1st chip antenna element and said 2nd chip antenna element are accommodated in one case.

20. The chip antenna according to claim 8, wherein said 1st chip antenna element and said 2nd chip antenna element are accommodated in one case.

21. The chip antenna according to claim 9, wherein said 1st chip antenna element and said 2nd chip antenna element are accommodated in one case.

22. The chip antenna according to claim 10, wherein said 1st chip antenna element and said 2nd chip antenna element are accommodated in one case.

23. The chip antenna according to claim 11, wherein said 1st chip antenna element and said 2nd chip antenna element are accommodated in one case.

24. The chip antenna according to claim 12, wherein said 1st chip antenna element and said 2nd chip antenna element are accommodated in one case.

25. The chip antenna according to claim 13, wherein a conductor member is formed on the lateral surface of said case.

26. An antenna device having said chip antenna according to claim 1, and having a substrate on which said chip antenna is mounted.

27. The antenna device according to claim 26, wherein said 1st chip antenna element and said 2nd chip antenna element are arranged taking curved shape or meander shape.

28. A communication equipment in which said chip antenna according to claim 1 is used.

29. The communication equipment according to claim 28, wherein said 1st chip antenna element and said 2nd chip antenna element are arranged taking curved shape or meander shape.

30. The communication equipment according to claim 29, wherein said chip antenna is arranged along the inner side face of a case of said communication equipment.

31. The communication equipment according to claim 28, wherein a substrate on which a conductor part is formed, is used, wherein at least one selected from the group consisting of said connection conductor between said chip antenna elements, and said protruding linear conductor, is connected to said conductor part on said substrate.

32. The communication equipment according to claim 29, wherein a substrate on which a conductor part is formed, is used, wherein at least one selected from the group consisting of said connection conductor between said chip antenna elements, and said protruding linear conductor, is connected to said conductor part on said substrate.

33. The communication equipment according to claim 30, wherein a substrate on which a conductor part is formed, is used, wherein at least one selected from the group consisting of said connection conductor between said chip antenna elements, and said protruding linear conductor, is connected to said conductor part on said substrate.

34. A communication equipment, using said chip antenna according to claim 25, wherein a substrate on which another conductor member is formed, is used, wherein said conductor member on said case and said another conductor member on said substrate, are connected.

* * * * *